US011320848B1

(12) United States Patent
Lin et al.

(10) Patent No.: US 11,320,848 B1
(45) Date of Patent: May 3, 2022

(54) VOLTAGE STABILIZATION CIRCUIT, VOLTAGE STABILIZATION METHOD, AND DISPLAY DEVICE

(71) Applicant: Xiamen Tianma Micro-Electronics Co., Ltd., Xiamen (CN)

(72) Inventors: Zhaomin Lin, Shanghai (CN); Lei Suo, Shanghai (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 17/320,684

(22) Filed: May 14, 2021

(30) Foreign Application Priority Data

Jan. 26, 2021 (CN) ..... 202110103588.3

(51) Int. Cl.
*G05F 1/56* (2006.01)
*G09G 3/20* (2006.01)

(52) U.S. Cl.
CPC ..... *G05F 1/56* (2013.01); *G09G 3/20* (2013.01); *G09G 2330/02* (2013.01)

(58) Field of Classification Search
CPC ..... G05F 1/56; G09G 3/20; G09G 2330/02
See application file for complete search history.

(56) References Cited

U.S. PATENT DOCUMENTS

2020/0027387 A1* 1/2020 Cheng ..... G09G 3/20
2020/0027400 A1* 1/2020 Zhang ..... G09G 3/20

FOREIGN PATENT DOCUMENTS

CN 208656415 U 3/2019
KR 20130036587 A 4/2013

* cited by examiner

*Primary Examiner* — Sejoon Ahn
(74) *Attorney, Agent, or Firm* — Anova Law Group, PLLC

(57) ABSTRACT

A voltage stabilization circuit includes a first sub-circuit. The first sub-circuit includes a first voltage stabilizing element; a first switching element; and a second switching element. For the first voltage stabilizing element, the first terminal is electrically connected to a first node, and the second terminal is grounded. For the first switching element, the first terminal is electrically connected to the first node, and the second terminal is electrically connected to a voltage stabilizing target. For the second switching element, the first terminal is electrically connected to the control terminal of the first switching element, and the control terminal is electrically connected to the first node. When the first voltage stabilizing element is in a first operating state, the second switching element is turned on, and the first switching element is turned off.

20 Claims, 15 Drawing Sheets

Voltage stabilization circuit containing P-type transistors

VOLTAGE STABILIZATION CIRCUIT, VOLTAGE STABILIZATION METHOD, AND DISPLAY DEVICE

CROSS-REFERENCE TO RELATED APPLICATION

This application claims the priority of Chinese patent application No. 202110103588.3, filed on Jan. 26, 2021, the entirety of which is incorporated herein by reference.

FIELD OF THE DISCLOSURE

The present disclosure generally relates to the field of electronic design and, more particularly, relates to a voltage stabilization circuit, a voltage stabilization method, and a display device.

BACKGROUND

Generally, in circuit design, voltage stabilizing components are usually used to stabilize the output or input voltage of a circuit. For example, in a display device, a capacitor is used as a voltage stabilizing element, and by adding the capacitor, the output signal of the integrated circuit and the input signal of the display panel can be stabilized. However, after the voltage stabilizing element fails, the circuit may not operate normally. Therefore, how to solve the problem of the circuit not operating properly has become a top priority.

The disclosed voltage stabilization circuit, voltage stabilization method, and display device are directed to solve one or more problems set forth above and other problems in the art.

BRIEF SUMMARY OF THE DISCLOSURE

One aspect of the present disclosure provides a voltage stabilization circuit. The voltage stabilization circuit includes a first sub-circuit. The first sub-circuit includes a first voltage stabilizing element; a first switching element; and a second switching element. The first terminal of the first voltage stabilizing element is electrically connected to a first node, and the second terminal of the first voltage stabilizing element is grounded. The first terminal of the first switching element is electrically connected to the first node, and the second terminal of the first switching element is electrically connected to a voltage stabilizing target. The first terminal of the second switching element is electrically connected to the control terminal of the first switching element, and the control terminal of the second switching element is electrically connected to the first node. When the first voltage stabilizing element is in a first operating state, the second switching element is turned on, and the first switching element is turned off.

Another aspect of the present disclosure provides a voltage stabilization method, applied to a voltage stabilization circuit. The voltage stabilization circuit includes a first sub-circuit, and the first sub-circuit includes a first voltage stabilizing element; a first switching element; and a second switching element. The first terminal of the first voltage stabilizing element is electrically connected to a first node, and the second terminal of the first voltage stabilizing element is grounded. The first terminal of the first switching element is electrically connected to the first node, and the second terminal of the first switching element is electrically connected to a voltage stabilizing target. The first terminal of the second switching element is electrically connected to the control terminal of the first switching element, and the control terminal of the second switching element is electrically connected to the first node. The voltage stabilization method includes, when the first voltage stabilizing element is in a first operating state, controlling the second switching element to be turned on and the first switching element to be turned off to disconnect the first voltage stabilizing element from the voltage stabilizing target.

Another aspect of the present disclosure provides a display device, including a voltage stabilization circuit. The voltage stabilization circuit includes a first sub-circuit, and the first sub-circuit includes a first voltage stabilizing element; a first switching element; and a second switching element. The first terminal of the first voltage stabilizing element is electrically connected to a first node, and the second terminal of the first voltage stabilizing element is grounded. The first terminal of the first switching element is electrically connected to the first node, and the second terminal of the first switching element is electrically connected to a voltage stabilizing target. The first terminal of the second switching element is electrically connected to the control terminal of the first switching element, and the control terminal of the second switching element is electrically connected to the first node. When the first voltage stabilizing element is in a first operating state, the second switching element is turned on, and the first switching element is turned off.

Other aspects of the present disclosure can be understood by those skilled in the art in light of the description, the claims, and the drawings of the present disclosure.

BRIEF DESCRIPTION OF THE DRAWINGS

In order to explain the technical solutions of the embodiments of the present disclosure more clearly, the following will briefly introduce the drawings that need to be used in the embodiments of the present disclosure. Obviously, the drawings described below are only some embodiments of the present disclosure, and a person with ordinary skills in the art can obtain other drawings based on these drawings without creative work.

DETAILED DESCRIPTION

Figure 1:
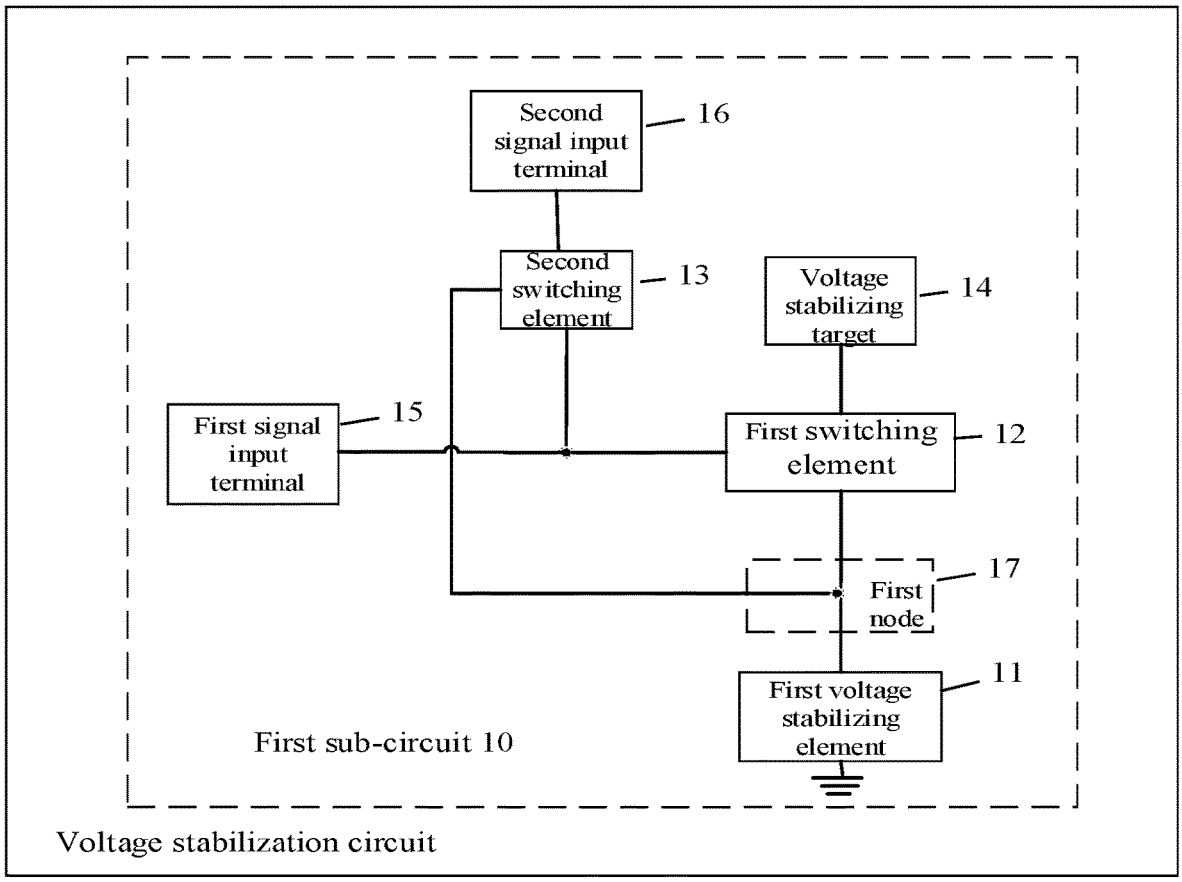
FIG. 1 illustrates a schematic structural diagram of an exemplary voltage stabilization circuit according to an embodiment of the present disclosure.

The features and exemplary embodiments of various aspects of the present disclosure will be described in detail below. In the following detailed description, many specific details are proposed in order to provide a comprehensive understanding of the present disclosure. However, it is obvious to those skilled in the art that the present disclosure can be implemented without some of these specific details. The following description of various embodiments is merely for providing a better understanding of the present disclosure with examples.

It should be noted that in the present disclosure, relational terms such as first and second are only used to distinguish one entity or operation from another entity or operation, and do not necessarily require or imply that there is any such actual relationship or order between these entities or operations. Moreover, the terms "comprise", "include" or any other variants thereof are intended to cover non-exclusive inclusion, so that a process, method, article, or device including a series of elements not only includes those elements, but also includes other elements that are not explicitly listed, or also includes elements inherent to this process, method, article, or device. Without further restrictions, elements defined by the sentence "including . . . " do not exclude the existence of other identical elements in the process, method, article, or device that includes the elements.

It should be noted that unless specifically stated otherwise, the relative arrangement of the components and steps, numerical expressions and numerical values set forth in the embodiments do not limit the scope of the present disclosure. The following description of the at least one exemplary embodiment is merely illustrative, and by no means can be considered as limitations for the application or use of the present disclosure. In addition, it should be noted that, for illustrative purposes, the drawings show, instead of all of the structure, only a part of the structure related to the present disclosure.

It should be noted that techniques, methods, and apparatuses known to those of ordinary skill in the relevant art may not be discussed in detail, but where appropriate, the techniques, methods, and apparatuses should be considered as part of the specification.

It should be noted that in all the examples provided and discussed herein, any specific value should be interpreted as merely exemplary and not as a limitation. Therefore, other examples of the exemplary embodiments may have different values.

It should be noted that similar reference numbers and letters indicate similar items in subsequent figures, and therefore, once an item is defined in a figure, it is not required to be further discussed or defined in the subsequent figures.

At present, the main accessories of a display panel terminal include driver integrated circuits (ICs) and flexible printed circuit (FPC) boards, and the most used electronic components on the FPC boards are the capacitors. The purpose of adding capacitors in FPC boards is to stabilize the output signal of the driver ICs and stabilize the input signal of the panel.

With the increasing reliability of display panel terminals, especially in the wearable field, due to space constraints, the size of the capacitors selected on FPC boards is getting smaller and smaller. However, the reliability of the capacitor is related to the reliability requirements of the panel terminal. Even when other modules of the panel perform well, a capacitor can cause a short circuit due to factors such as environmental water vapor, high temperature, or external force damage. Because the first terminal of the capacitor is electrically connected with a continuous operating signal, the second terminal is electrically connected with the ground, when the capacitor is short-circuited, the operating signal input terminal is grounded. As such, the operating signal is not able to drive other modules to operate, leading to the failure of the entire terminal of the display panel.

Before introducing the voltage stabilization circuit provided by various embodiments of the present disclosure, the technical terminology involved in the embodiment of the present disclosure will be introduced.

Electrostatic discharge (ESD) is a process of high potential, strong electric field, and instantaneous high current. In an ESD process, a large instantaneous pulse current is often generated, causing damage to the electronic components in the circuit.

It should be noted that the voltage stabilization circuit and the voltage stabilization method provided in the embodiments of the present disclosure are not only applicable to the display panel, but also applicable to scenarios where the voltage stabilizing element is used, such as a radio frequency amplifying circuit. The embodiments of the present disclosure take the application of a voltage stabilization circuit in a display panel as an example for detailed illustration.

In the embodiments of the present disclosure, the control terminal of a transistor is the gate of the transistor. In the following, the voltage stabilization circuit according to various embodiments of the present disclosure will be described first.

The present disclosure provides a voltage stabilization circuit. FIG. 1 illustrates a schematic structural diagram of an exemplary voltage stabilization circuit according to an embodiment of the present disclosure. Referring to FIG. 1, in one embodiment, the voltage stabilization circuit may include a first sub-circuit 10. The first sub-circuit 10 may include a first voltage stabilizing element 11, a first switching element 12, and a second switching element 13.

In one embodiment, the first terminal of the first voltage stabilizing element 11 may be electrically connected to a first node 17. The first node 17 may include a node between the first terminal of the first switching element 12 and the control terminal of the second switching element 13. The second terminal of the first voltage stabilizing element 11 may be grounded. The first voltage stabilizing element 11 can be used to stabilize the voltage of a voltage stabilizing target 14.

The first terminal of the first switching element 12 may be electrically connected to the first node 17. The second terminal of the first switching element 12 may be electrically connected to the voltage stabilizing target 14. The control terminal of the first switching element 12 may be electrically connected to the first terminal of the second switching element 13.

When the first switching element 12 is turned on, the first voltage stabilizing element 11 may be connected with the voltage stabilizing target 14 through the first switching element 12. When the first switching element 12 is turned off, the first voltage stabilizing element 11 may be disconnected from the voltage stabilizing target 14.

The first terminal of the second switching element 13 may be electrically connected to the control terminal of the first switching element 12. The control terminal of the second switching element 13 may be electrically connected to the first node 17. In one embodiment, the second terminal of the second switch element 13 may be electrically connected to the second signal input terminal.

Because the control terminal of the first switching element 12 is connected to the first terminal of the second switching element 13, the conduction state of the second switching element 13 can affect the conduction state of the first switching element 12. Because the control terminal of the second switching element 13 is electrically connected to the first voltage stabilizing element 11, the operating state of the voltage stabilizing element 11 can affect the conduction state of the second switching element 13.

In one embodiment, the voltage stabilizing target may include an operating signal. The conduction states of the first switching element and the second switching element may include on, semi-on, off, and semi-off. It should be noted that semi-on refers to incomplete on, and semi-off refers to incomplete off.

In the above embodiment, two switching elements and one voltage stabilizing element are used to form the basic structure of the voltage stabilization circuit, which demonstrates the advantage of simple structure and ensures normal operation of the circuit. Based on the circuit structure described above, the first voltage stabilizing element can be used to control the conduction state of the second switching element, and the second switching element can be used to control the conduction state of the first switching element. Therefore, the operating state of the first voltage stabilizing element may affect the conduction state of the two switching elements, and the first switching element may control the connection between the first voltage stabilizing element and the voltage stabilizing target. Therefore, whether the voltage stabilizing target is disconnected can be determined according to the operating state of the first voltage stabilizing element, thereby ensuring normal operation of the voltage stabilizing target when the voltage stabilizing element fails to operate normally. As such, the circuit-failure risk may be reduced.

In some embodiments, as shown in FIG. 1, when the first voltage stabilizing element 11 is in the first operating state, the second switching element 13 may be turned on, and the first switching element 12 may be turned off, such that the first switching element 12 is turned off. The voltage stabilizing element 11 may be disconnected from the voltage stabilizing target.

In one embodiment, the first operating state may include an abnormal operating state. Because the first voltage stabilizing element 11 is in an abnormal operating state, the voltage across the two terminals of the first voltage stabilizing element 11 may change. In other words, when the first voltage stabilizing element 11 is in an abnormal operating state, the voltage at the first node 17 may change. When the voltage difference between the first node 17 and the second signal input terminal 16 meets the turn-on condition of the second switching element 13, the second switching element 13 may be turned on. When the second switching element 13 is turned on, the voltage at the control terminal of the first switching element 12 may change. When the voltage difference between the control terminal of the first switching element 12 and the voltage stabilizing target 14 meets the turn-off condition of the first switching element 12, the first switching element 12 may be turned off. In one embodiment, the first operating state may include a short-circuit operating state.

In the above embodiment, Because the first voltage stabilizing element 11 is electrically connected to the control terminal of the second switching element 13, the second switching element 13 is electrically connected to the control terminal of the first switching element 12, and the first voltage stabilizing element 11 is connected to the voltage stabilizing target 14 through the first switching element 12. Therefore, when the first voltage stabilizing element 11 fails to operate normally, the voltage across the first voltage stabilizing element 11 may change. As such, the second switching element 13 may reach the turn-on condition, and thus the second switching element 13 may be turned on. Because the second switching element 13 is turned on, the voltage at the control terminal of the first switching element 12 may change. As such, the first switching element 12 may reach the turn-off condition, and thus the first switching element 12 may be turned off. Therefore, the first voltage stabilizing element 11 may be disconnected from the voltage stabilizing target 14. In this way, the use of the above-mentioned voltage stabilization circuit can disconnect the voltage stabilizing element from the circuit by turning off the switching element after the stabilizing element fails to operate. As such, the normal operation of the circuit can be protected.

In some embodiments, as shown in FIG. 1, when the first voltage stabilizing element 11 is in a second operating state, the first switching element 12 may be turned on, and the second switching element 13 may be turned off, such that the first voltage stabilizing element 11 may be connected with the voltage stabilizing target through the first switching element 12.

In one embodiment, the second operating state may include a normal operating state. When the first voltage stabilizing element 11 is in a normal operating state, the voltage stabilizing element may isolate direct current, thereby stabilizing the voltage at the first node 17 and making the voltage of the voltage stabilizing target 14 stable. In one embodiment, the second operating state may include an operating state in which the first voltage stabilizing element isolates direct current.

When the first voltage stabilizing element 11 is in a normal operating state, the voltage difference between the voltage stabilizing target 14 and the control terminal of the first switching element 12 may meet the turn-on condition of the first switching element 12, and thus the first switching element 12 may be turned on. In the voltage stabilization circuit shown in FIG. 1, the first voltage stabilizing element 11 is connected to the voltage stabilizing target 14 through the first switching element 12. Therefore, when the first switching element 12 is turned on, the first voltage stabilizing element 11 may be connected with the voltage stabilizing target 14 through the first switching element 12, such that the first voltage stabilizing element 11 may be able to stabilize the voltage of the voltage stabilizing target 14.

In addition, when the first switching element 12 is turned on, the voltage difference between the first node 17 and the second signal input terminal 16 may meet the turn-off condition of the second switching element 13, and thus the second switching element 13 may be turned off, thereby preventing the second switching element 13 from controlling the first switching element 12 to turn off.

In the above embodiment, because the first voltage stabilizing element 11 is electrically connected to the control terminal of the second switching element 13, the second switching element 13 may be electrically connected to the control terminal of the first switching element 12, and the first voltage stabilizing element 11 may be connected to the voltage stabilizing target 14 through the first switching element 12. Therefore, by using the above-mentioned voltage stabilization circuit, after the voltage stabilizing element is in a normal operating state, the first voltage stabilizing element can be connected to the voltage stabilizing target by turning off the second switching element and turning on the first switching element. As such, the first voltage stabilizing element may be able to stabilize the voltage stabilizing target.

In some embodiments, as shown in FIG. 1, when the first voltage stabilizing element 11 is in a current surge state, the second switching element 13 may be turned on and the first switching element 12 may be turned off, or the two switching elements 13 may be turned semi-on, and the first switching element 12 may be turned semi-off.

In one embodiment, the external circuit will generate a large instantaneous pulse current during the ESD process, and when the large instantaneous pulse current is inputted into the voltage stabilization circuit, the first voltage stabilizing element may be impacted by the large pulse current. In turn, the first voltage stabilizing element 11 may be in the current surge state. In one embodiment, the current surge state may include a state where the first voltage stabilizing element 11 is impacted by a pulse current exceeding a preset intensity. The preset intensity can be determined according to the intensity of the pulse current that the first voltage stabilizing element 11 can withstand. When the first voltage stabilizing element 11 is subjected to an impact exceeding the preset current intensity, the pulse current may break down the first voltage stabilizing element 11. As a result, the internal resistance of the first voltage stabilizing element 11 may decrease, and the voltage across the first voltage stabilizing element 11 may change. Because the first voltage stabilizing element 11 has its own anti-pulse capability, the first voltage stabilizing element 11 can be restored to the second operating state after a period of time.

When the first voltage stabilizing element 11 is in the current surge state, the voltage across the first voltage stabilizing element 11 may change. Because the first node 17 is arranged at the first terminal of the first voltage stabilizing element 11, the voltage at the first node 17 may also change accordingly. When the voltage difference between the first node 17 and the second signal input terminal 16 meets the turn-on condition of the second switching element 13, the second switching element 13 may be turned on. When the second switching element 13 is turned on, the voltage at the control terminal of the first switching element 12 may change. When the voltage difference between the control terminal of the first switching element 12 and the voltage stabilizing target 14 meets the turn-off condition of the first switching element 12, the first switching element 12 may be turned off, such that the first voltage stabilizing element 11 is disconnected from the voltage stabilizing target 14.

In one embodiment, the pulse current may be inputted from the voltage stabilizing target, and the first voltage stabilizing element 11 is connected to the voltage stabilizing target 14 through the first switching element 12. Therefore, when the first voltage stabilizing element 11 is in the current surge state, the first switching element 12 may be turned off. As such, the first voltage stabilizing element 11 can be disconnected from the voltage stabilizing target 14, thereby avoiding the first voltage stabilizing element 11 from being impacted by the pulse current.

In some embodiments, when the voltage difference between the first node 17 and the second signal input terminal 16 meets the semi-on condition of the second switching element 13, the second switching element 13 may be turned semi-on. When the second switching element 13 is semi-on, the voltage at the control terminal of the first switching element 12 may change. When the voltage difference between the control terminal of the first switching element 12 and the voltage stabilizing target 14 meets the semi-off condition of the first switching element 12, the first switching element 12 may be turned semi-off. As such, the first voltage stabilizing element 11 and the voltage stabilizing target 14 may not be completely disconnected, the first voltage stabilizing element 11 can stabilize the voltage of the voltage stabilizing target 14.

In one embodiment, the pulse current may be inputted from the voltage stabilizing target, and the first voltage stabilizing element is connected to the voltage stabilizing target through the first switching element. Therefore, when the first voltage stabilizing element is in the current surge state, the second switching element may be turned semi-on and the first switching element may be turned semi-off, which can reduce the impact of the pulse current on the first voltage stabilizing element. In this way, the use of the voltage stabilization circuit can improve the pulse current resistance of the first voltage stabilizing element.

After a period of time, because the first voltage stabilizing element itself has the ability to resist pulses, the first voltage stabilizing element may switch from the current-surge operating state to the second operating state, the first switching element 12 may be turned on, and the second switching element 13 may be turned off. As such, the first voltage stabilizing element 11 may be connected with the voltage stabilizing target through the first switching element 12.

In one embodiment, after a period of time, the first voltage stabilizing element 11 may be in a normal operating state again. The voltage difference between the voltage stabilizing target 14 and the control terminal of the first switching element 12 may meet the turn-on condition of the first switching element 12, and thus the first switching element 12 may be turned on. In the voltage stabilization circuit shown in FIG. 1, the first voltage stabilizing element 11 is connected to the voltage stabilizing target 14 through the first switching element 12. Therefore, when the first switching element 12 is turned on, the first voltage stabilizing element 11 may be connected with the voltage stabilizing target 14 through the first switching element 12. As such, the first voltage stabilizing element 11 may be able to stabilize the voltage of the voltage stabilizing target 14.

When the first switching element 12 is turned on, the voltage difference between the first node 17 and the second signal input terminal 16 may meet the turn-off condition of the second switching element 13, and thus the second switching element 13 may be turned off.

In the above embodiment, the conduction state of the second switching element is determined by the voltage difference between the first node and the second signal input terminal. Therefore, when the first voltage stabilizing element is impacted by a pulse current of a certain intensity, a voltage drop may occur, resulting in a drop in the voltage at the first node. The voltage at the second signal input terminal may be adjusted to increase the intensity of the pulse current that the voltage stabilizing element can withstand, thereby improving the ESD resistance of the voltage stabilization circuit.

In addition, in the voltage stabilization circuit, the ESD resistance of the voltage stabilizing element can be adjusted, thereby balancing the ESD resistance of the stabilizing element and the panel. As such, the ESD resistance of the entire module may be improved.

Figure 2:
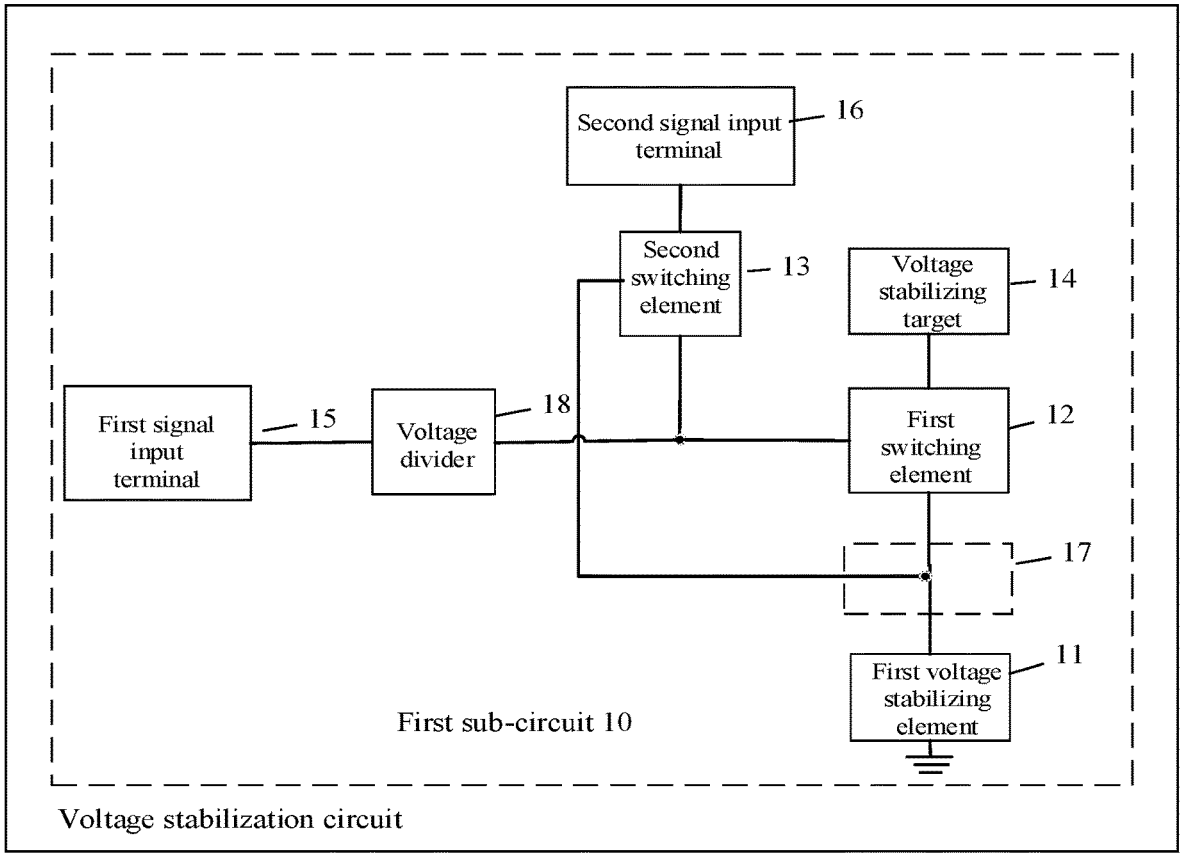
FIG. 2 illustrates a schematic structural diagram of another exemplary voltage stabilization circuit according to an embodiment of the present disclosure.

FIG. 2 illustrates a schematic structural diagram of another exemplary voltage stabilization circuit according to an embodiment of the present disclosure. Referring to FIG. 2, in one embodiment, in order to ensure that the first switching element 12 can be normally turned off when the first voltage stabilizing element is in the first operating state, the first sub-circuit 10 may further include a voltage divider 18.

One terminal of the voltage divider 18 may be electrically connected to a node between the control terminal of the first switching element and the first terminal of the second switching element. In one embodiment, the other terminal of the voltage divider 18 may be electrically connected to the first signal input terminal 15.

In one embodiment, when the first voltage stabilizing element is in the first operating state, the second switching element 13 may be turned on. In order to avoid potential competition between the first terminal of the second switching element 13 and the first signal input terminal causing the first switching element 12 unable to be turned off normally, a voltage divider 18 may be disposed between the first signal input terminal 16 and the first terminal of the second switching element 13.

Figure 3:
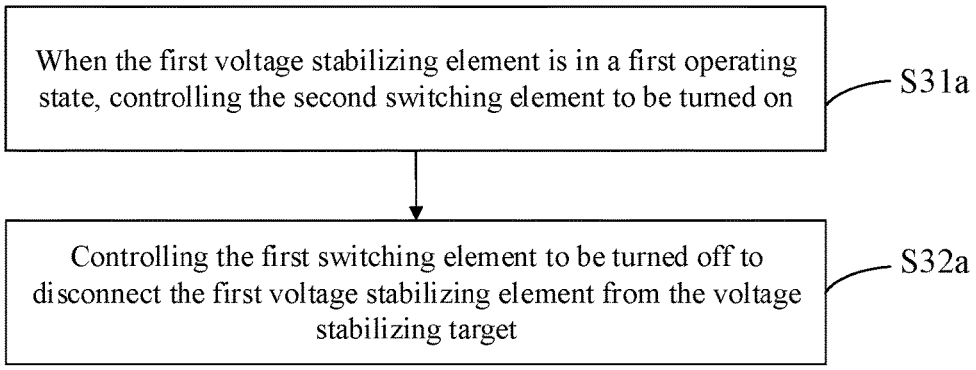
FIG. 3 illustrates a schematic flowchart of an exemplary voltage stabilization method according to an embodiment of the present disclosure.

The present disclosure also provides a voltage stabilization method. FIG. 3 illustrates a schematic flowchart of an exemplary voltage stabilization method according to an embodiment of the present disclosure. Referring to FIG. 3, the voltage stabilization method may include the following exemplary steps.

In S31*a*, when a first voltage stabilizing element 11 is in a first operating state, a second switching element 13 may be controlled to be turned on.

In one embodiment, the first operating state may include an abnormal operating state. When the first voltage stabilizing element 11 is in an abnormal operating state, the voltage at a first node 17 may change. When the voltage difference between the first node 17 and a second signal input terminal 16 meets the turn-on condition of the second switching element 13, the second switching element 13 may be controlled to be turned on.

In S32*a*, when the second switching element 13 is turned on, the first switching element 12 may be controlled to be turned off to disconnect the first voltage stabilizing element from a voltage stabilizing target.

In one embodiment, when the second switching element 13 is turned on, the voltage at the control terminal of the first switching element 12 may change. When the voltage difference between the control terminal of the first switching element 12 and the voltage stabilizing target 14 meets the turn-off condition of the first switching element 12, the first switching element 12 may be controlled to be turned off.

In the above implementation, after the first voltage stabilizing element fails to operate, the first voltage stabilizing element may be disconnected from the circuit by turning off the switching element, thereby protecting the normal operation of the circuit.

In some embodiments, the voltage stabilization method may further include the following exemplary steps.

In S31*b*, when the first voltage stabilizing element 11 is in the second operating state, the first switching element 12 may be controlled to be turned on.

In one embodiment, the second operating state may include a normal operating state. When the first voltage stabilizing element 11 is in a normal operating state, the voltage difference between the voltage stabilizing target 14 and the control terminal of the first switching element 12 may meet the turn-on condition of the first switching element 12, and thus the first switching element 12 may be controlled to be turned on.

In S32*b*, when the first switching element 12 is turned on, the second switching element 13 may be controlled to be turned off to connect the voltage stabilizing target to the first voltage stabilizing element.

In one embodiment, when the voltage difference between the first node 17 and the second signal input terminal 16 meets the turn-off condition of the second switching element 13, the second switching element 13 may be turned off, which prevents the second switching element 13 from controlling the first switching element 12 to turn off. Therefore, the first voltage stabilizing element 11 may be connected to the voltage stabilizing target 14 through the first switching element 12, such that the first voltage stabilizing element 11 may stabilize the voltage of the voltage stabilizing target 14.

In the above embodiment, after the voltage stabilizing element is in a normal operating state, the first voltage stabilizing element 11 may be connected to the voltage stabilizing target 14 by turning off the second switching element 13 and turning on the first switching element 12. As such, the first voltage stabilizing element 11 may stabilize the voltage stabilizing target 14.

In some embodiments, the voltage stabilization method may further include the following exemplary steps.

In S31*c*, when the first voltage stabilizing element 11 is in the current surge state, the second switching element 13 may be controlled to be turned on.

In one embodiment, the current surge state may include a state where the first voltage stabilizing element 11 is impacted by a pulse current exceeding a preset intensity. When the first voltage stabilizing element 11 is in the current surge state, the voltage across the two terminals of the first voltage stabilizing element 11 may change. Because the first node is arranged at the first terminal of the first voltage stabilizing element 11, the voltage at the first node 17 may also change accordingly. When the voltage difference between the first node 17 and the second signal input terminal 16 meets the turn-on condition of the second switching element 13, the second switching element 13 may be controlled to be turned on.

In S32*c*, when the second switching element 13 is turned on, the first switching element 12 may be controlled to be turned off to disconnect the first voltage stabilizing element 11 from the voltage stabilizing target 14.

In one embodiment, when the second switching element 13 is turned on, the voltage at the control terminal of the first switching element 12 may change. When the voltage difference between the control terminal of the first switching element 12 and the voltage stabilizing target 14 meets the turn-off condition of the first switching element 12, the first switching element 12 may be controlled to be turned off to disconnect the first voltage stabilizing element 11 from the voltage stabilizing target 14.

In the above embodiment, the pulse current may be brought by the voltage stabilizing target, and the first voltage stabilizing element 11 may be connected to the voltage stabilizing target 14 through the first switching element 12. Therefore, when the first voltage stabilizing element 11 is in the current surge state, the first switching element 12 may be turned off. As such, the first voltage stabilizing element 11 may be disconnected from the voltage stabilizing target 14, thereby preventing the impact of the pulse current on the first voltage stabilizing element 11.

In some embodiments, the voltage stabilization method may further include the following exemplary steps.

In S31*d*, when the first voltage stabilizing element 11 is in the current surge state, the second switching element 13 may be controlled to be turned semi-on.

In one embodiment, when the first voltage stabilizing element 11 is in the current surge state, the voltage across the two terminals of the first voltage stabilizing element 11 may drop to a certain extent. Because the first node 17 is arranged at the first terminal of the first voltage stabilizing element 11, the voltage at the first node 17 may also drop accordingly. When the voltage difference between the first node 17 and the second signal input terminal 16 meets the semi-on condition of the second switching element 13, the second switching element 13 may be turned semi-on.

In S32*d*, when the second switching element 13 is semi-on, the first switching element 12 may be controlled to be turned semi-off.

In one embodiment, when the second switching element 13 is in a semi-on state, the voltage at the control terminal of the first switching element 12 may change. When the voltage difference between the control terminal of the first switching element 12 and the voltage stabilizing target 14 meets the semi-off condition of the first switching element 12, the first switching element 12 may be controlled to be turned semi-off. As a result, the first voltage stabilizing element 11 and the voltage stabilizing target 14 may not be completely disconnected, and the first voltage stabilizing element 11 may be able to stabilize the voltage of the voltage stabilizing target 14.

In some embodiments, in order to ensure that the voltage stabilization circuit can operate normally when the first voltage stabilizing element impacted by pulses is restored to the second operating state, the voltage stabilization method may further include the following exemplary steps.

When the first voltage stabilizing element is switched from the current-surge operating state to the second operating state, the first switching element 12 may be controlled to be turned on and the second switching element 13 may be turned off. As such, the first voltage stabilizing element 11 may be connected with the voltage stabilizing target through the first switching element 12.

In some embodiments, in order to improve the ESD resistance of the voltage stabilization circuit, the voltage stabilization method may further include controlling the voltage at the second signal input terminal 16, and adjusting the intensity of the pulse current that the first voltage stabilizing element 11 can withstand.

In one embodiment, when the first voltage stabilizing element 11 is impacted by a pulse current of a certain intensity, the voltage across the two terminals may change, causing the voltage at the first node 17 to change. Because the conduction state of the second switching element 13 is determined due to the voltage difference between the first node 17 and the second signal input terminal 16, the voltage at the second signal input terminal 16 can be adjusted to increase the intensity of the pulse current that the first voltage stabilizing element 11 can withstand, thereby improving the ESD resistance of the voltage stabilization circuit.

In addition, because in the voltage stabilization circuit, the ESD resistance of the voltage stabilizing element can be adjusted, thereby balancing the ESD resistance of the stabilizing element and the panel. As such, the ESD resistance of the entire module may be improved.

Figure 4:
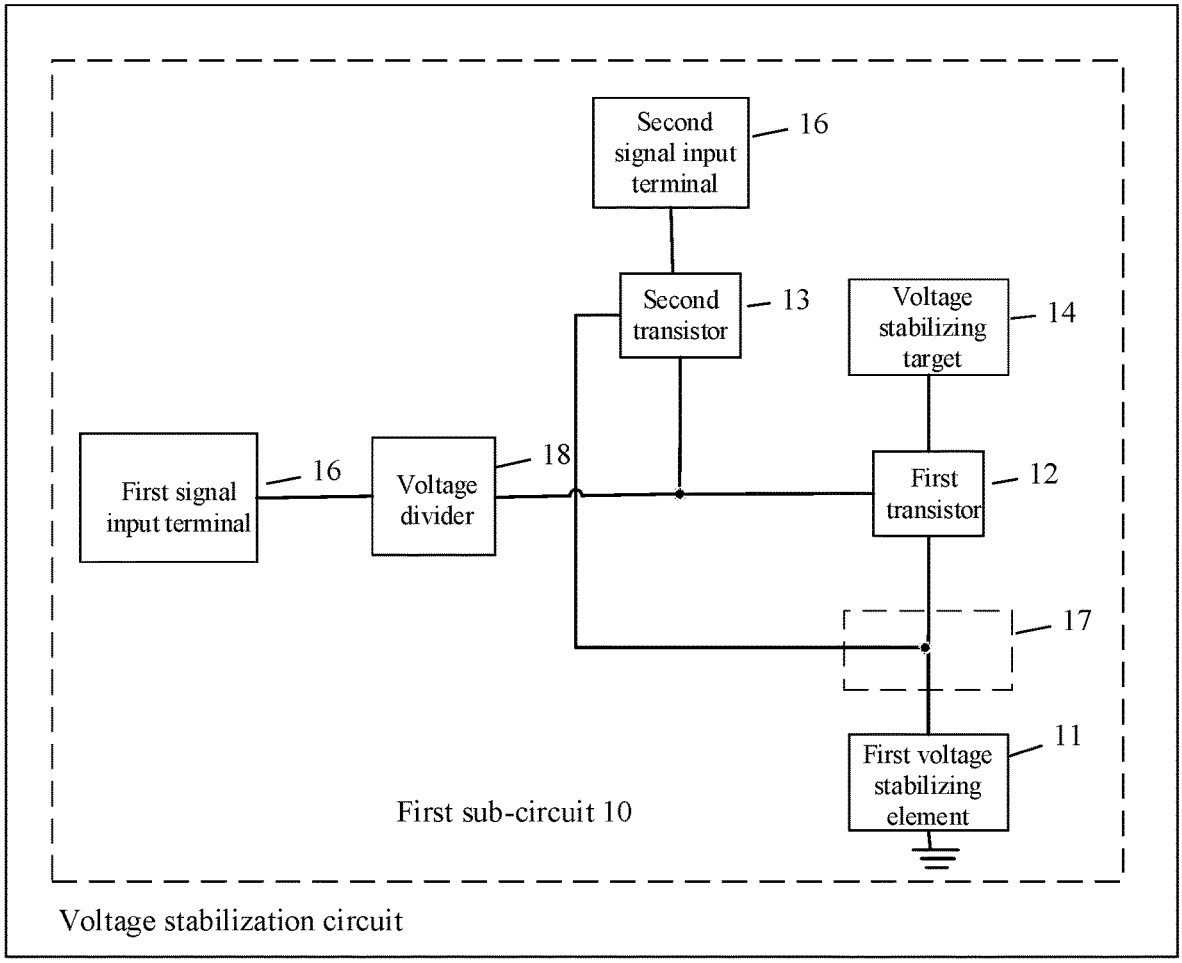
FIG. 4 illustrates a schematic flowchart of another exemplary voltage stabilization method according to an embodiment of the present disclosure.

FIG. 4 illustrates a schematic flowchart of another exemplary voltage stabilization method according to an embodiment of the present disclosure. Referring to FIG. 4, in some embodiments, the first switching element 12 may include a first transistor Q1, and the second switching element 13 may include a second transistor Q2.

In various embodiments of the present disclosure, the types of the first transistor Q1 and the second transistor Q2 are not limited. For example, the first transistor Q1 and the second transistor Q2 may be P-type transistors or N-type transistors.

The first terminal of the first voltage stabilizing element 11 may be electrically connected to the first node 17. The first node 17 may include a node between the first terminal of the first transistor Q1 and the control terminal of the second transistor Q2. The second terminal of the first voltage stabilizing element 11 may be grounded. The first voltage stabilizing element 11 may be used to stabilize the voltage of the voltage stabilizing target 14.

The first terminal of the first transistor Q1 may be electrically connected to the first node 17. The second terminal of the first transistor Q1 may be electrically connected to the voltage stabilizing target 14. The control terminal of the first transistor Q1 may be electrically connected to the first terminal of the second transistor Q2.

The first terminal of the second transistor Q2 may be electrically connected to the control terminal of the first transistor Q1. The second terminal of the second transistor Q2 may be electrically connected to the input terminal of the second signal. The control terminal of the second transistor Q2 may be electrically connected to the first node 17.

In one embodiment, because the control terminal of the first transistor Q1 is connected to the first terminal of the second transistor Q2, the conduction state of the first transistor Q1 may be affected by the conduction state of the second transistor Q2. Because the control terminal of the second transistor Q2 is electrically connected to the first voltage stabilizing element 11, the operating state of the first voltage stabilizing element 11 may affect the conduction state of the second switching element 13.

In one embodiment, the conduction states of the first transistor Q1 and the second transistor Q2 may include on, semi-on, off, and semi-off. It should be noted that semi-on refers to incomplete on, and semi-off refers to incomplete off.

Figure 5:
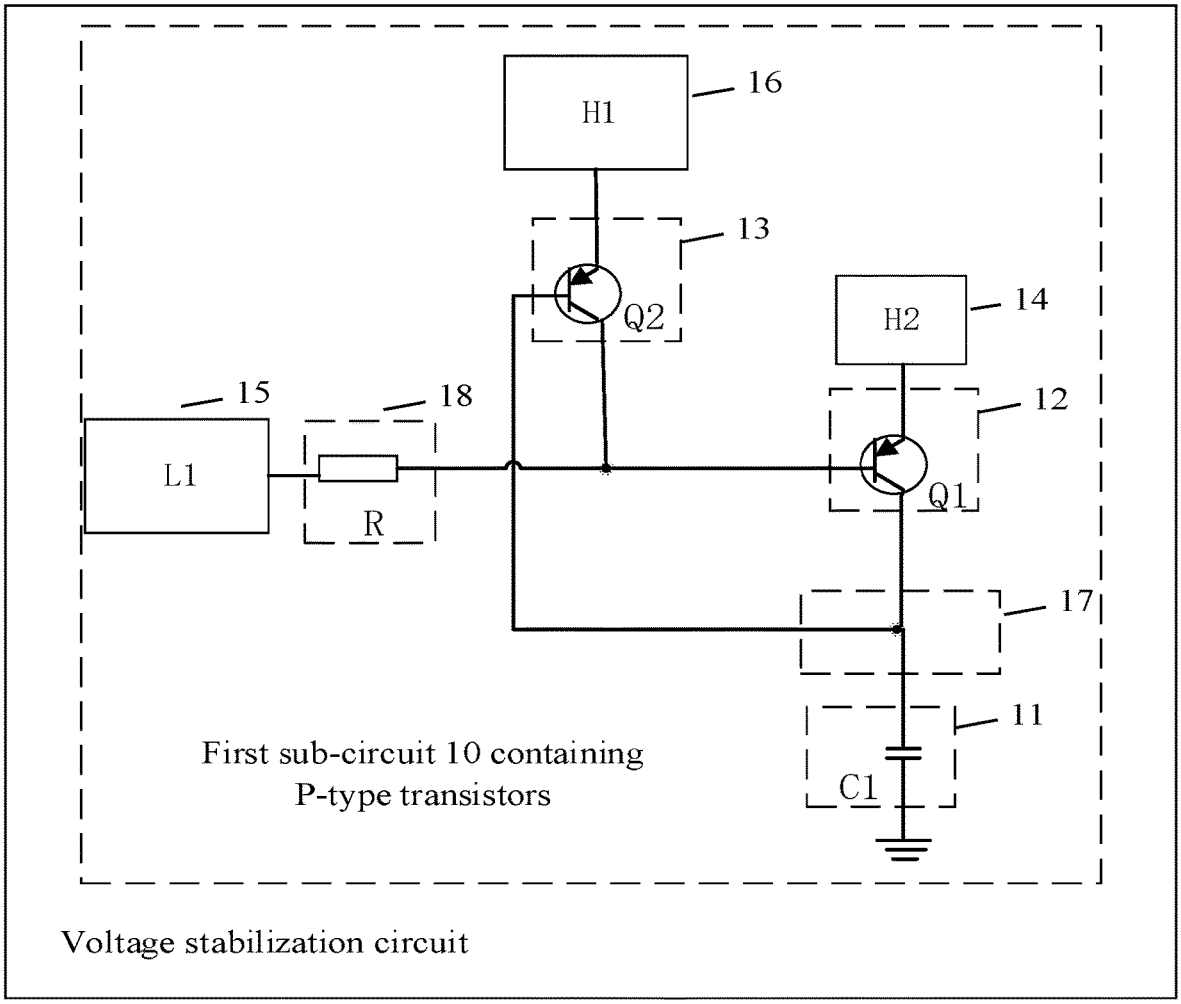
FIG. 5 illustrates a schematic structural diagram of an exemplary voltage stabilization circuit including a P-type transistor according to an embodiment of the present disclosure.

FIG. 5 illustrates a schematic structural diagram of an exemplary voltage stabilization circuit including a P-type transistor according to an embodiment of the present disclosure. Referring to FIG. 5, in some embodiments, both the first transistor Q1 and the second transistor Q2 are P-type transistors. Because a P-type transistor is turned on when the voltage difference between the gate and the second terminal of the transistor is less than the threshold voltage, the conduction through the P-type transistor can also be understood as low-level conduction (e.g., the P-type transistor may be a low-level on transistor).

In one embodiment, the first signal input terminal 15 may be a negative voltage input terminal, and the second signal input terminal 16 may be a positive voltage input terminal. The voltage stabilizing target 14 may be a positive voltage operating signal.

In one embodiment, the first terminal of the first voltage stabilizing element 11 and the first node 17 may be electrically connected. The first node 17 may include a node between the first terminal of the first transistor Q1 and the gate of the second transistor Q2. The second terminal of the first voltage stabilizing element 11 may be grounded. The first voltage stabilizing element 11 may be used to stabilize the voltage of the voltage stabilizing target 14.

The first terminal of the first transistor Q1 may be electrically connected to the first node 17. The second terminal of the first transistor Q1 may be electrically connected to the voltage stabilizing target 14. The gate of the first transistor Q1 may be electrically connected to the first terminal of the second transistor Q2.

In one embodiment, when the first transistor Q1 is turned on, the first voltage stabilizing element 11 may be connected to the voltage stabilizing target 14 through the first transistor Q1. When the first transistor Q1 is turned off, the first voltage stabilizing element 11 may be disconnected from the voltage stabilizing target 14.

The first terminal of the second transistor Q2 may be electrically connected to the gate of the first transistor Q1. The second terminal of the second transistor Q2 may be electrically connected to the second signal input terminal. The gate of the second transistor Q2 may be electrically connected to the first node 17.

Because the gate of the first transistor Q1 is connected to the first terminal of the second transistor Q2, the conduction state of the first transistor Q1 may be affected by the conduction state of the second transistor Q2. Because the gate of the second transistor Q2 is electrically connected to the first voltage stabilizing element 11, the operating state of the first voltage stabilizing element 11 may affect the conduction state of the second transistor Q2.

In one embodiment, the conduction states of the first transistor Q1 and the second transistor Q2 may include on, semi-on, off, and semi-off. It should be noted that semi-on refers to incomplete on, and semi-off refers to incomplete off.

In some embodiments, in order to ensure that the first transistor Q1 can be turned off normally when the first voltage stabilizing element is in the first operating state, as shown in FIG. 5, the first sub-circuit 10 may further include a voltage divider 18.

One terminal of the voltage divider 18 may be electrically connected to a node between the gate of the first transistor Q1 and the first terminal of the second transistor Q2. In one embodiment, the other terminal of the voltage divider 18 may be electrically connected to the negative voltage input terminal.

In one embodiment, when the first voltage stabilizing element is in the first operating state, the second transistor Q2 may be turned on. In order to avoid potential competition between the first terminal of the second transistor Q2 and the negative voltage input terminal causing the first transistor Q1 unable to be turned off normally, a voltage divider 18 may be disposed between the negative voltage input terminal and the first terminal of the second transistor Q2.

In one embodiment, the voltage divider 18 may include a resistor R.

In one embodiment, the first voltage stabilizing element 11 may include a first capacitor C1.

It should be noted that, in various embodiments of the present disclosure, the first voltage stabilizing element 11 may include, but is not limited to, a capacitor. For example, the first voltage stabilizing element 11 may be one or more of electronic elements such as a diode, a transient diode, and a varistor.

The present disclosure also provides another voltage stabilization method, and the voltage stabilization method may include the following exemplary steps.

In S51, a negative voltage signal may be inputted into a negative voltage input terminal, a first positive voltage signal may be inputted into a positive voltage input terminal, and a second positive voltage signal may be inputted into a voltage stabilizing target.

In one embodiment, in one embodiment, the negative voltage signal may be the turn-on voltage L1 of a first transistor Q1, and the first positive voltage signal may be the turn-off voltage H1 of the first transistor Q1. The second positive voltage signal may be an operating signal H2. The turn-on voltage L1 may be a negative voltage signal, and the turn-off voltage H1 and the operating signal H2 may be positive voltage signals.

In some embodiments, the voltage stabilization method may further include the following exemplary steps.

In S52*a*, when a first capacitor C1 is in the first operating state, based on the first positive voltage signal and because a first node is connected to the ground through the first transistor Q1, a second transistor Q2 may be controlled to be turned on.

In one embodiment, the first operating state may include a short-circuit operating state. When the first capacitor C1 is in the short-circuit operating state, because the first node 17 is connected to the ground through the first capacitor C1, the voltage at the first node 17 may decrease. Because the first node is electrically connected to the gate of the second transistor Q2, when the voltage difference between the voltage at the first node 17 and the turn-off voltage H1 is less than the threshold voltage of the second transistor Q2, the second transistor Q2 may be controlled to be turned on.

In S53*a*, because the second transistor Q2 is turned on, the first transistor Q1 may be controlled to be turned off.

In one embodiment, based on the second transistor Q2 being turned on, the turn-off voltage H1 may be transmitted to the gate of the first transistor Q1 through the second transistor Q2. When the voltage difference between the gate of the first transistor Q1 and the operating signal H2 is less than the threshold voltage of the first transistor Q1, the first transistor Q1 may be controlled to be turned off.

In some embodiments, the voltage stabilization method may further include the following exemplary steps.

In S52*b*, when the first voltage stabilizing element is in the second operating state, the first transistor may be controlled to be turned on based on the negative voltage signal and the second positive voltage signal.

In one embodiment, the second operating state may include an operating state in which the voltage stabilizing element isolates direct current. When the voltage difference between the turn-on voltage L1 and the operating signal H2 is less than the threshold voltage of the first transistor Q1, the first transistor Q1 may be controlled to be turned on.

In S53*b*, based on the first transistor Q1 being turned on, the second transistor Q2 may be controlled to be turned off.

In one embodiment, when the first transistor is turned on, the operating signal H2 may be transmitted to the first node through the first transistor Q1. Because the first node is electrically connected to the gate of the second transistor Q2, when the voltage difference between the voltage at the first node 17 and the turn-off voltage H1 is greater than the threshold voltage of the second transistor Q2, the second transistor Q2 may be controlled turns off.

In some embodiments, the voltage stabilization method may further include the following exemplary steps.

In S52*c*, when the first voltage stabilizing element is in the current surge state, based on the drop in the voltage of the first voltage stabilizing element and the drop in the voltage at the first node, the second transistor may be controlled to be turned on.

In one embodiment, the current surge state may include a state where the first capacitor C1 is impacted by a pulse current exceeding a preset intensity. When the first capacitor C1 is in the current surge state, the voltage difference between the two terminals of the first capacitor C1 may drop to a certain extent. Because the first node is arranged at the first terminal of the first capacitor C1, the voltage at the first node 17 may also decrease. When the voltage difference between the voltage at the first node 17 and the turn-off voltage H1 is less than the threshold voltage of the second transistor Q2, the second switching element 13 may be controlled to be turned on.

In S53*c*, based on the second transistor being turned on, the first transistor may be controlled to be turned off.

In one embodiment, because the second transistor Q2 is turned on, the turn-off voltage H1 may be transmitted to the gate of the first transistor Q1 through the second transistor Q2. When the voltage difference between the gate of the first transistor Q1 and the operating signal H2 is greater than the threshold voltage of the first transistor Q1, the first transistor Q1 may be controlled to be turned off.

In the above embodiment, the pulse current may be brought by the voltage stabilizing target, and the first capacitor C1 may be connected to the operating signal H2 through the first transistor Q1. Therefore, when the first capacitor C1 is in the current surge state, the first transistor Q1 may be turned off, which can disconnect the first capacitor C1 from the operating signal H2, and thus avoid the impact of the pulse current carried by the operating signal.

In some embodiments, the voltage stabilization method may include the following exemplary steps.

In S52*d*, when the first voltage stabilizing element 11 is in the current surge state, the second transistor Q2 may be controlled to be turned semi-on.

In one embodiment, when the first voltage stabilizing element 11 is in the current surge state, the voltage across the two terminals of the first voltage stabilizing element 11 may drop to a certain extent. Because the first node 17 is arranged at the first terminal of the first voltage stabilizing element 11, the voltage at the first node 17 may also drop accordingly. Because the first node is electrically connected to the gate of the second transistor Q2, when the voltage difference between the voltage at the first node 17 and the turn-off voltage H1 is less than the threshold voltage of the second transistor Q2, the second transistor Q2 may be controlled to be turned semi-on.

In S53*d*, based on the semi-on of the second transistor, the first transistor may be controlled to be turned semi-off.

In one embodiment, because the second transistor Q2 is semi-conductive, the turn-off voltage H1 is transmitted to the gate of the first transistor Q1 through the second transistor Q2. When the voltage difference between the gate of the first transistor Q1 and the operating signal H2 is greater than the threshold voltage of the first transistor Q1, the first transistor Q1 may be controlled to be turned semi-off.

In some embodiments, in order to ensure that the voltage stabilization circuit can operate normally when the first voltage stabilizing element impacted by pulses is restored to the second operating state, the voltage stabilization method may further include the following exemplary steps.

When the first capacitor C1 is switched from the current-surge operating state to the second operating state, the first transistor Q1 may be controlled to be turned on and the second transistor Q2 may be turned off, such that the first capacitor C1 may be connected to the operating signal H2 through the first transistor Q1.

In some embodiments, in order to improve the ESD resistance of the voltage stabilization circuit, the voltage stabilization method may further include controlling the value of the turn-off voltage H1 and adjusting the intensity of the pulse current that the first capacitor C1 can withstand.

Figure 6:
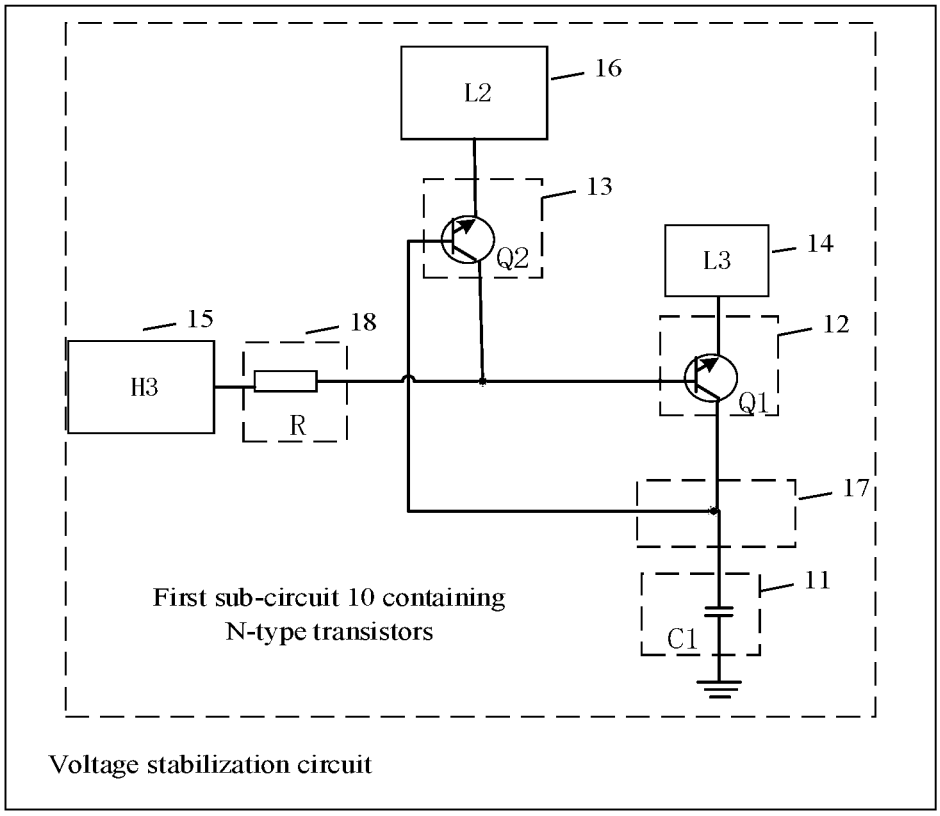
FIG. 6 illustrates a schematic structural diagram of an exemplary voltage stabilization circuit including an N-type transistor according to an embodiment of the present disclosure.

FIG. 6 illustrates a schematic structural diagram of an exemplary voltage stabilization circuit including an N-type transistor according to an embodiment of the present disclosure. Referring to FIG. 6, in some embodiments, both the first transistor Q1 and the second transistor Q2 are N-type transistors, and the N-type transistors are high-level on transistors.

In one embodiment, the first signal input terminal 15 may be a positive voltage input terminal, and the second signal input terminal 16 may be a negative voltage input terminal. The voltage-stabilizing target 14 may be an operating signal of a negative voltage.

In one embodiment, the first terminal of the first voltage stabilizing element 11 and the first node 17 may be electrically connected. The first node 17 may include a node between the first terminal of the first transistor Q1 and the gate of the second transistor Q2. The second terminal of the first voltage stabilizing element 11 may be grounded. The first voltage stabilizing element 11 can be used to stabilize the voltage of the voltage stabilizing target 14.

The first terminal of the first transistor Q1 may be electrically connected to the first node 17. The second terminal of the first transistor Q1 may be electrically connected to the voltage stabilizing target 14. The gate of the first transistor Q1 may be electrically connected to the first terminal of the second transistor Q2, and may also be electrically connected to the positive voltage input terminal.

In one embodiment, when the first transistor Q1 is turned on, the first voltage stabilizing element 11 may be connected to the voltage stabilizing target 14 through the first transistor Q1. When the first transistor Q1 is turned off, the first voltage stabilizing element 11 may be disconnected from the voltage stabilizing target 14.

The first terminal of the second transistor Q2 may be electrically connected to the gate of the first transistor Q1. The second terminal of the second transistor Q2 may be electrically connected to the negative voltage input terminal. The gate of the second transistor Q2 may be electrically connected to the first node 17.

Because the gate of the first transistor Q1 is connected to the first terminal of the second transistor Q2, the conduction state of the first transistor Q1 can be affected by the conduction state of the second transistor Q2. Because the gate of the second transistor Q2 is electrically connected to the first voltage stabilizing element 11, the operating state of the first voltage stabilizing element 11 can affect the conduction state of the second transistor Q2.

Here, the conduction states of the first transistor Q1 and the second transistor Q2 may include on, semi-on, off, and semi-off. It should be noted that semi-on refers to incomplete on, and semi-off refers to incomplete off.

In some embodiments, in order to ensure that the first transistor Q1 can be turned off normally when the first voltage stabilizing element is in the first operating state, as shown in FIG. 6, the first sub-circuit 10 may further include a voltage divider 18.

One terminal of the voltage divider 18 may be electrically connected to a node between the gate of the first transistor Q1 and the first terminal of the second transistor Q2. In one embodiment, the other terminal of the voltage divider 18 may be electrically connected to the negative voltage input terminal.

In one embodiment, when the first voltage stabilizing element is in the first operating state, the second transistor Q2 may be turned on. In order to avoid potential competition between the first terminal of the second transistor Q2 and the positive voltage input terminal causing the first transistor Q1 unable to be turned off normally, a voltage divider 18 may be disposed between the positive voltage input terminal and the first terminal of the second transistor Q2.

In one embodiment, referring to FIG. 6, the voltage divider 18 may include a resistor R.

In one embodiment, the first voltage stabilizing element 11 may include a first capacitor C1.

It should be noted that, in various embodiments of the present disclosure, the first voltage stabilizing element 11 may include, but is not limited to, a capacitor. For example, the first voltage stabilizing element 11 may be one or more of electronic elements such as a diode, a transient diode, and a varistor.

The present disclosure also provides another voltage stabilization method, and the voltage stabilization method may include the following exemplary steps.

In S61, a positive voltage signal may be inputted into a positive voltage input terminal, a first negative voltage signal may be inputted into a negative voltage input terminal, and a second negative voltage signal may be inputted into a voltage stabilizing target 14.

In one embodiment, the positive voltage signal may be the turn-on voltage H3 of a first transistor Q1, and the first negative voltage signal may be the turn-off voltage L2 of the first transistor Q1. The second negative voltage signal may be an operating signal L3. The turn-on voltage H3 may be a positive voltage signal, and the turn-off voltage L2 and the operating signal L3 may be negative voltage signals.

In some embodiments, the voltage stabilization method may further include the following exemplary steps.

In S62*a*, when the first voltage stabilizing element is in the first operating state, based on the first negative voltage signal and because the first node is connected to the ground through the first voltage stabilizing element, the second transistor may be controlled to be turned on.

In one embodiment, the first operating state may include a short-circuit operating state. When the first capacitor C1 is in the short-circuit operating state, because the first node 17 is connected to the ground through the first capacitor C1, the voltage at the first node 17 may decrease. Because the first node 17 is electrically connected to the gate of the second transistor Q2, when the voltage difference between the voltage at the first node 17 and the turn-off voltage L2 is greater than the threshold voltage of the second transistor Q2, the second transistor Q2 may be controlled to be turned on.

In S63*a*, based on the second transistor being turned on, the first transistor Q1 may be controlled to be turned off.

In one embodiment, because the second transistor Q2 is turned on, the turn-off voltage L2 may be transmitted to the gate of the first transistor Q1 through the second transistor Q2. When the voltage difference between the gate of the first transistor Q1 and the operating signal L3 is less than the threshold voltage of the first transistor Q1, the first transistor Q1 may be controlled to be turned off.

In some embodiments, the voltage stabilization method may further include the following exemplary steps.

In S62*d*, when the first voltage stabilizing element is in the second operating state, the first transistor may be controlled to be turned on based on the positive voltage signal and the second negative voltage signal.

In one embodiment, the second operating state may include an operating state in which the voltage stabilizing element isolates direct current. In a case where the voltage difference between the turn-on voltage H3 and the operating signal L3 is greater than the threshold voltage of the first transistor Q1, the first transistor Q1 may be controlled to be turned on.

In S63*b*, based on the first transistor being turned on, the second transistor may be controlled to be turned off.

In one embodiment, when the first transistor is turned on, the operating signal L3 may be transmitted to the first node 17 through the first transistor Q1. Because the first node 17 is electrically connected to the gate of the second transistor Q2, when the voltage difference between the voltage at the first node 17 and the turn-off voltage L2 is less than the threshold voltage of the second transistor Q2, the second transistor Q2 may be controlled to be turned off.

In some embodiments, the voltage stabilization method may also include the following exemplary steps.

In S62*c*, when the first voltage stabilizing element is in the current surge state, based on the voltage increase of the first voltage stabilizing element and the voltage increase of the first node, the second transistor may be controlled to be turned on.

In one embodiment, the current surge state may include a state where the first capacitor C1 is impacted by a pulse current exceeding a preset intensity. When the first capacitor C1 is in the current surge state, the voltage across the two terminals of the first capacitor C1 may increase to a certain extent. Because the first node is arranged at the first terminal of the first capacitor C1, the voltage at the first node 17 may increase accordingly. When the voltage difference between the voltage at the first node 17 and the turn-off voltage L2 is greater than the threshold voltage of the second transistor Q2, the second transistor Q2 may be controlled to be turned on.

In S63*c*, based on the second transistor being turned on, the first transistor may be controlled to be turned off.

In one embodiment, because the second transistor Q2 is turned on, the turn-off voltage L2 may be transmitted to the gate of the first transistor Q1 through the second transistor Q2. When the voltage difference between the gate of the first transistor Q1 and the operating signal L3 is less than the threshold voltage of the first transistor Q1, the first transistor Q1 may be controlled to be turned off.

In the above embodiment, the pulse current may be brought by the voltage stabilizing target, and the first capacitor C1 may be connected to the operating signal L3 through the first transistor Q1. Therefore, when the first capacitor C1 is in the current surge state, the first transistor Q1 may be turned off, which can disconnect the first capacitor C1 from the operating signal H2, avoiding the impact of the pulse current carried by the operating signal L3.

In some embodiments, the voltage stabilization method may include the following exemplary steps.

In S62*d*, when the first voltage stabilizing element 11 is in the current surge state, based on the voltage increase of the first voltage stabilizing element and the voltage increase of the first node, the second transistor Q2 may be controlled to be turned semi-on.

In one embodiment, when the first voltage stabilizing element 11 is in the current surge state, the voltage across the first capacitor C1 may increase to a certain extent. Because the first node 17 is arranged at the first terminal of the first capacitor C1, the voltage at the first node 17 may also increase accordingly. Because the first node is electrically connected to the gate of the second transistor Q2, when the voltage difference between the voltage at the first node 17 and the turn-off voltage L2 is greater than the threshold voltage of the second transistor Q2, the second transistor Q2 may be controlled to be turned semi-on.

In S63*d*, based on the second transistor being turned semi-on, the first transistor may be controlled to be turned semi-off.

In one embodiment, because the second transistor Q2 is semi-on, the turn-off voltage H1 may be transmitted to the gate of the first transistor Q1 through the second transistor Q2. When the voltage difference between the gate of the first transistor Q1 and the operating signal L3 is less than the threshold voltage of the first transistor Q1, the first transistor Q1 may be controlled to be turned semi-off.

In some embodiments, in order to ensure that the voltage stabilization circuit can operate normally when the first voltage stabilizing element impacted by pulses is restored to the second operating state, the voltage stabilization method may further include the following exemplary steps.

When the first capacitor C1 is switched from the operating state of the current impact to the second operating state, the first transistor Q1 may be controlled to be turned on and the second transistor Q2 may be turned off, so that the first capacitor C1 may be connected with the operating signal L3 through the first transistor Q1.

In some embodiments, in order to improve the ESD resistance of the voltage stabilization circuit, the voltage stabilization method may further include controlling the value of the turn-off voltage L2 and adjusting the intensity of the pulse current that the first capacitor C1 can withstand.

Figure 7:
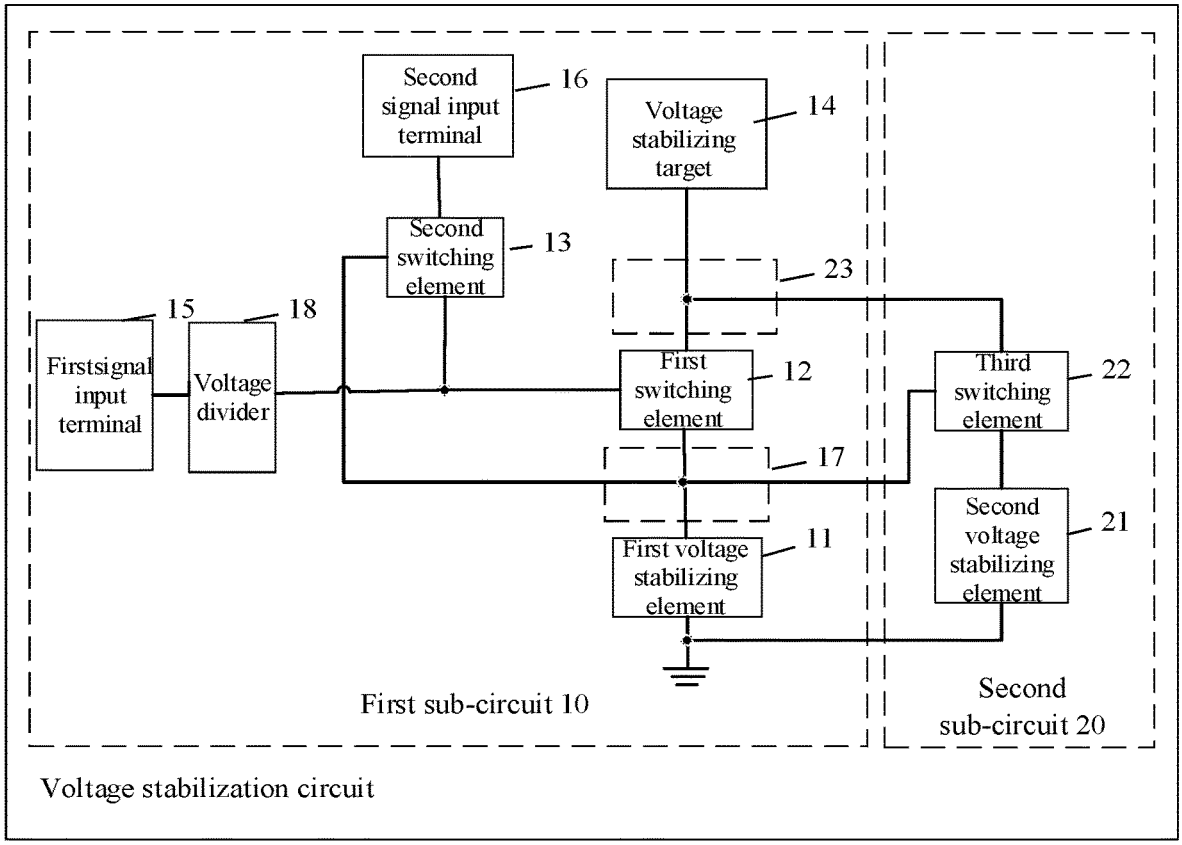
FIG. 7 illustrates a schematic structural diagram of an exemplary voltage stabilization circuit including a second sub-circuit according to an embodiment of the present disclosure.

FIG. 7 illustrates a schematic structural diagram of an exemplary voltage stabilization circuit including a second sub-circuit according to an embodiment of the present disclosure. Referring to FIG. 7, in one embodiment, in order to realize the function of voltage stabilization when the first voltage stabilizing element fails to operate normally, the voltage stabilization circuit may include a first sub-circuit 10 and a second sub-circuit 20. The first sub-circuit 10 may include a first voltage stabilizing element 11, a first switching element 12, and a second switching element 13. The second sub-circuit 20 may include a second voltage stabilizing element 21 and a third switching element 22.

It should be noted that the structure of the first sub-circuit is the same as the structure of the first sub-circuit in the embodiment described above, and will not be repeated here.

In one embodiment, the first terminal of the second voltage stabilizing element 21 may be electrically connected to the first terminal of the third switching element 22, and the second terminal of the second voltage stabilizing element 21 may be grounded.

The control terminal of the third switch element 22 may be electrically connected to the first node 17 of the first sub-circuit 10, and the second terminal of the third switch element 22 may be electrically connected to the second node 23. The second node 23 may include a node between the second terminal of the first switching element 12 and the voltage stabilizing target 14.

In one embodiment, because the second voltage stabilizing element 21 is connected to the voltage stabilizing target 14 through the third switching element 22, when the third switching element 22 is turned on, the second voltage stabilizing element 21 can be connected with the voltage stabilizing target 14 through the third switching element 22. The voltage stabilizing target 14 is connected. When the third switching element 22 is turned off, the second voltage stabilizing element 21 may be disconnected from the voltage stabilizing target 14.

In one embodiment, the control terminal of the third switching element 22 may be electrically connected to the first node 17, that is, the control terminal of the third switching element 22 may be electrically connected to the first terminal of the first voltage stabilizing element 11 in the first sub-circuit 10, and also be electrically connected to the first terminal of the first switching element 12 in the first sub-circuit 10. Therefore, the operating state of the first voltage stabilizing element 11 in the first sub-circuit 10 can affect the conduction state of the third switching element 22.

In one embodiment, the conduction state of the third switching element 22 may include on, semi-on, off, and semi-off. It should be noted that semi-on refers to incomplete on, and semi-off refers to incomplete off.

In the above embodiment, the second sub-circuit including the second voltage stabilizing element and the third switching element may form a supplementary circuit for the first sub-circuit, such that when the first sub-circuit cannot implement the voltage stabilization function, the second sub-circuit may be able to replace the first sub-circuit to implement the voltage stabilization function.

In one embodiment, in the voltage stabilization circuit shown in FIG. 7, when the first voltage stabilizing element 11 in the first sub-circuit 10 is in the first operating state and the second voltage stabilizing element 21 is in the second operating state, the second switching element 13 may be turned on, the first switching element 12 may be turned off, and the third switching element 22 may be turned on. As such, the first voltage stabilizing element 11 may be disconnected from the voltage stabilizing target 14, and the second voltage stabilizing element 12 may be connected to the voltage stabilizing target 14.

In one embodiment, the second operating state may include a normal operating state. When the second voltage stabilizing element 21 is in a normal operating state, the voltage stabilizing element may isolate direct current, thereby stabilizing the voltage at the first node 17 and making the voltage of the voltage stabilizing target 14 stable.

The first operating state may include an abnormal operating state. Because the first voltage stabilizing element 11 is in an abnormal operating state, the voltage across the two terminals of the first voltage stabilizing element 11 may change. In other words, when the first voltage stabilizing element 11 is in an abnormal operating state, the voltage at the first node 17 may change. When the voltage difference between the first node 17 and the second signal input terminal 16 meets the turn-on condition of the second switching element 13, the second switching element 13 may be turned on. When the second switching element 13 is turned on, the voltage at the control terminal of the first switching element 12 may change. When the voltage difference between the control terminal of the first switching element 12 and the voltage stabilizing target 14 meets the turn-off condition of the first switching element 12, the first switching element 12 may be turned off, such that the first voltage stabilizing element 11 may be disconnected from the voltage stabilizing target 14.

When the first voltage stabilizing element 11 is in an abnormal operating state and the second voltage stabilizing element 21 is in a normal operating state, the voltage at the first node 17 may change. When the voltage difference between the first node 17 and the voltage stabilizing target 14 meets the turn-on condition of the third switching element 22, the third switching element 22 may be turned on, such that the second voltage stabilizing element 21 may be connected to the voltage stabilizing target 14. As such, the second voltage stabilizing element 21 can stabilize the voltage of the voltage stabilizing target 14.

In one embodiment, the second sub-circuit 20 may be equivalent to a supplementary circuit for the first sub-circuit 10. When the first voltage stabilizing element 11 in the first sub-circuit 10 fails to operate normally, the first switching element 12 may be turned off, and the third switching element 22 may be turned on.

In the above embodiment, the second sub-circuit 20 may be equivalent to a supplementary circuit for the first sub-circuit 10. When the first voltage stabilizing element 11 in the first sub-circuit 10 fails to operate normally, the first switching element 12 may be turned off, and the third switching element 22 may be turned on. As such, the first voltage stabilizing element 11 may be disconnected from the voltage stabilizing target, the second voltage stabilizing element 21 may replace the first voltage stabilizing element 11 to be connected with the voltage stabilizing target 14, and the second voltage stabilizing element 21 may replace the first voltage stabilizing element 11 to stabilize the voltage stabilizing target.

In some embodiments, when the first voltage stabilizing element 11 is in the second operating state, the first switching element 12 may be turned on, the second switching element 13 may be turned off, and the third switching element 22 may be turned off.

In one embodiment, when the first voltage stabilizing element 11 is in a normal operating state, the voltage difference between the voltage stabilizing target 14 and the control terminal of the first switching element 12 may meet the turn-on condition of the first switching element 12, and the first switching element 12 may be controlled to be turned on. In the voltage stabilization circuit shown in FIG. 4, the first voltage stabilizing element 11 may be connected to the voltage stabilizing target 14 through the first switching element 12. Therefore, when the first switching element 12 is turned on, the first voltage stabilizing element 11 may be connected with the voltage stabilizing target 14 through the first switching element 12, such that the first voltage stabilizing element 11 may stabilize the voltage of the voltage stabilizing target 14.

When the first switching element 12 is turned on, the voltage difference between the first node 17 and the second signal input terminal 16 may meet the turn-off condition of the second switching element 13, such that the second switching element 13 may be turned off.

When the first switching element 12 is turned on, the voltage difference between the first node 17 and the voltage stabilizing target 14 may meet the turn-off condition of the third switching element 22, and thus the third switching element 22 may be turned off. As such, the second voltage stabilizing element 21 may be disconnected from the voltage stabilizing target 14, and the second voltage stabilizing element 21 may be suspended.

In one embodiment, as shown in FIG. 7, when the first voltage stabilizing element 11 is in a current surge state, the second switching element 13 may be turned on, the first switching element 12 may be turned off, and the third switching element 22 may be turned on. Alternatively, the second switching element 13 may be turned semi-on, the first switching element 12 may be turned semi-off, and the third switching element 22 may be turned semi-on.

In one embodiment, when the first voltage stabilizing element 11 is impacted by a pulse current exceeding a preset intensity, the pulse current may break down the first voltage stabilizing element 11, causing the internal resistance of the first voltage stabilizing element 11 to decrease, and the voltage across the two terminals of the first voltage stabilizing element 11 may change. Because the first voltage stabilizing element 11 itself has the ability to resist pulses, the first voltage stabilizing element 11 may be restored to the second operating state after a period of time.

When the first voltage stabilizing element 11 is in a current surge state, the voltage across the two terminals of the first voltage stabilizing element 11 may change. Because the first node 17 is arranged at the first terminal of the first voltage stabilizing element 11, the voltage at the first node 17 may also change accordingly.

When the voltage difference between the first node 17 and the second signal input terminal 16 meets the turn-on condition of the second switching element 13, the second switching element 13 may be turned on. When the second switching element 13 is turned on, the voltage at the control terminal of the first switching element 12 may change. When the voltage difference between the control terminal of the first switching element 12 and the voltage stabilizing target 14 meets the turn-off condition of the first switching element 12, the first switching element 12 may be turned off, such that the first voltage stabilizing element 11 may be disconnected from the voltage stabilizing target 14.

In one embodiment, the pulse current may be inputted from the voltage stabilizing target 14, and the first voltage stabilizing element 11 may be connected to the voltage stabilizing target 14 through the first switching element 12. Therefore, when the first voltage stabilizing element 11 is in a current surge state, the first switching element 12 may be turned off, which can disconnect the first voltage stabilizing element 11 from the voltage stabilizing target 14, thereby preventing the first voltage stabilizing element 11 from being impacted by the pulse current.

Because the first node 17 is electrically connected to the control terminal of the third switching element 22, when the voltage at the first node 17 changes and the voltage difference between the first node 17 and the voltage stabilizing target 14 meets the turn-on condition of the third switching element 22, the third switching element 22 may be turned on. As such, the second voltage stabilizing element 21 may be connected to the voltage stabilizing target 14, and thus the second voltage stabilizing element 21 may replace the first voltage stabilizing element 11 to stabilize the voltage of the voltage stabilizing target 14.

In some embodiments, when the voltage difference between the first node 17 and the second signal input terminal 16 meets the semi-on condition of the second switching element 13, the second switching element 13 may be turned semi-on. When the second switching element 13 is semi-on, the voltage at the control terminal of the first switching element 12 may change. When the voltage difference between the control terminal of the first switching element 12 and the voltage stabilizing target 14 meets the semi-off condition of the first switching element 12, the first switching element 12 may be turned semi-off. As such, the first voltage stabilizing element 11 and the voltage stabilizing target 14 may not be completely disconnected, and the first voltage stabilizing element 11 may stabilize the voltage of the voltage stabilizing target 14.

In the case where the voltage at the first node 17 changes, when the voltage difference between the first node 17 and the voltage stabilizing target 14 meets the semi-on condition of the third switching element 22, the third switching element 22 may be turned semi-on. Therefore, the second voltage stabilizing element 21 may be connected to the voltage stabilizing target 14. As such, the second voltage stabilizing element 21 and the first voltage stabilizing element 11 may jointly stabilize the voltage of the voltage stabilizing target 14.

In one embodiment, because the pulse current may be inputted from the voltage stabilizing target 14, the first voltage stabilizing element 11 may be connected to the voltage stabilizing target 14 through the first switching element 12, and the second voltage stabilizing element 21 may be connected to the voltage stabilizing target 14 through the third switching element 22. Therefore, when the first voltage stabilizing element 11 is in a current surge state, the second switching element 13 may be turned semi-on, the first switching element 12 may be turned semi-off, and the third switching element 22 may be turned semi-on. As such, the second voltage stabilizing element 21 may bear part of the pulse current received by the first voltage stabilizing element 11. Therefore, the impact strength of the pulse current on the first voltage stabilizing element 11 may be reduced, and the recovery time of the first voltage stabilizing element may be shortened. As such, the use of the disclosed voltage stabilization circuit may be able to improve the pulse current resistance of the first voltage stabilizing element.

After a period of time, because the first voltage stabilizing element 11 itself has the ability to resist pulses, the first voltage stabilizing element 11 may switch from the current-surge operating state to the second operating state, the first switching element 12 may be turned on, the second switching element 13 may be turned off, and the third switching element 22 may be turned off. As such, the first voltage stabilizing element 11 may be connected with the voltage stabilizing target through the first switching element 12, and the second voltage stabilizing element 21 may be disconnected from the voltage stabilizing target through the first switching element 12.

In one embodiment, after a period of time, the first voltage stabilizing element 11 may be in a normal operating state again. The voltage difference between the voltage stabilizing target 14 and the control terminal of the first switching element 12 may meet the turn-on condition of the first switching element 12, and thus the first switching element 12 may be turned on. In the voltage stabilization circuit shown in FIG. 7, the first voltage stabilizing element 11 is connected to the voltage stabilizing target 14 through the first switching element 12. Therefore, when the first switching element 12 is turned on, the first voltage stabilizing element 11 may be connected the voltage stabilizing target 14 through the first switching element 12, such that the first voltage stabilizing element 11 may stabilize the voltage of the voltage stabilizing target 14.

When the first switching element 12 is turned on, the voltage difference between the first node 17 and the second signal input terminal 16 may meet the turn-off condition of the second switching element 13, and thus the second switching element 13 may be turned off. In addition, the voltage difference between the first node 17 and the voltage stabilizing target 14 may meet the turn-off condition of the third switching element 22, and thus the third switching element 22 may be turned off. Therefore, the second voltage stabilizing element 21 may be disconnected from the voltage stabilizing target 14, and the second voltage stabilizing element 21 may be suspended.

In the embodiment mentioned above, when the first voltage stabilizing element 11 is impacted by a pulse current of a certain intensity, the voltage across the two terminals may change, causing the voltage at the first node 17 to change. Because the voltage difference between the first node and the second signal input terminal determines the conduction state of the second switching element 13, the intensity of the pulse current that the voltage stabilization circuit can withstand may be improved by adjusting the voltage at the second signal input terminal 16. As such, the ESD resistance of the voltage stabilization circuit may be improved.

In addition, in the voltage stabilization circuit, the ESD resistance of the first voltage stabilizing element can be adjusted, thereby balancing the ESD resistance of the voltage stabilizing element and the panel. As such, the ESD resistance of the entire module may be improved.

In one embodiment, in order to ensure that the first switching element 12 can be normally turned off when the first voltage stabilizing element is in the first operating state, as shown in FIG. 7, the first sub-circuit 10 may further include a voltage divider 18.

One terminal of the voltage divider 18 may be electrically connected to a node between the control terminal of the first switching element 12 and the first terminal of the second switching element 13. The other terminal of the voltage divider 18 may be electrically connected to the first signal input terminal 15.

In one embodiment, when the first voltage stabilizing element 11 is in the first operating state, the second switching element 13 may be turned on. In order to avoid potential competition between the first terminal of the second switching element 13 and the first signal input terminal causing the first switching element 12 unable to be turned off normally, a voltage divider 18 may be disposed between the first signal input terminal 16 and the first terminal of the second switching element 13.

The present disclosure also provides another voltage stabilization method, which can be applied to the voltage stabilization circuit shown in FIG. 7. The voltage stabilization method may include the following exemplary steps.

In S71*a*, when a first voltage stabilizing element is in a first operating state and a second voltage stabilizing element is in a second operating state, a second switching element and a third switching element may be controlled to be turned on.

In one embodiment, the first operating state may include an abnormal operating state. When the first voltage stabilizing element 11 is in an abnormal operating state, the voltage at a first node 17 may change. When the voltage difference between the first node 17 and a second signal input terminal 16 meets the turn-on condition of the second switching element 13, the second switching element 13 may be controlled to be turned on. In addition, because the voltage at the first node 17 changes, when the voltage difference between the first node 17 and a voltage stabilizing target 14 meets the turn-on condition of the third switching element 22, the third switching element 22 may be controlled to be turned on.

In S72*a*, when the second switching element and the third switching element are turned on, the first switching element 12 may be turned off, such that the first voltage stabilizing element may be disconnected from the voltage stabilizing target, and the second voltage stabilizing element may be connected to the voltage stabilizing target.

In one embodiment, when the second switching element 13 is turned on, the voltage at the control terminal of the first switching element 12 may change. When the voltage difference between the control terminal of the first switching element 12 and the voltage stabilizing target 14 meets the turn-off condition of the first switching element 12, the first switching element 12 may be controlled to be turned off, such that the first voltage stabilizing element 11 may be disconnected from the voltage stabilizing target 14. In addition, when the third switching element 22 is turned on, the second voltage stabilizing element 21 may be connected to the voltage stabilizing target 14, such that the second voltage stabilizing element 21 may stabilize the voltage of the voltage stabilizing target 14.

In the above embodiment, when the first voltage stabilizing element 11 in the first sub-circuit 10 fails to operate normally, the first switching element 12 may be controlled to be turned off, and the third switching element 22 may be controlled to be turned on, such that the first voltage stabilizing element 11 may be disconnected from the voltage stabilizing target, the second voltage stabilizing element 21 may replace the first voltage stabilizing element 11 to be connected with the voltage stabilizing target 14, and the second voltage stabilizing element 21 may replace the first voltage stabilizing element 11 to stabilize the voltage stabilizing target.

In some embodiments, the voltage stabilization method may further include the following exemplary steps.

In S71*b*, when the first voltage stabilizing element 11 is in the second operating state, the first switching element 12 may be controlled to be turned on.

In one embodiment, when the first voltage stabilizing element 11 is in a normal operating state, the voltage difference between the control terminal of the first switching element 12 and the voltage stabilizing target 14 may meet the turn-on condition of the first switching element 12, and thus the first switching element 12 may be turned on. When the first switching element 12 is turned on, the first voltage stabilizing element 11 may be connected with the voltage stabilizing target 14 through the first switching element 12, such that the first voltage stabilizing element 11 may stabilize the voltage of the voltage stabilizing target 14.

In S72*b*, when the first switching element 12 is in the on state, the second switching element 13 and the third switching element 22 may be controlled to be turned off, such that the voltage stabilizing target 14 may be connected with the first voltage stabilizing element 11, and the voltage stabilizing target 14 may be disconnected from the second voltage stabilizing element 21.

In one embodiment, when the first switching element 12 is turned on, the voltage difference between the first node 17 and the second signal input terminal 16 may meet the turn-off condition of the second switching element 13, and thus the second switching element 13 may be turned off. In addition, when the first switching element 12 is turned on, the voltage difference between the first node 17 and the voltage stabilizing target 14 may meet the turn-off condition of the third switching element 22, and thus the third switching element 22 may be turned off. As such, the second voltage stabilizing element 21 may be disconnected from the voltage stabilizing target 14, and the second voltage stabilizing element 21 may be suspended.

In some embodiments, the voltage stabilization method may further include the following exemplary steps.

In S71*c*, when the first voltage stabilizing element 11 is in a current surge state, the second switching element 13 and the third switching element 22 may be controlled to be turned on.

In one embodiment, when the first voltage stabilizing element 11 is in a current surge state, the voltage across the two terminals of the first voltage stabilizing element 11 may drop to a certain extent. Because the first node 17 is arranged at the first terminal of the first voltage stabilizing element 11, the voltage at the first node 17 may also drop accordingly. When the voltage difference between the first node 17 and the second signal input terminal 16 meets the turn-on condition of the second switching element 13, the second switching element 13 may be controlled to be turned on. Because the first node 17 is electrically connected to the control terminal of the third switching element 22, when the voltage at the first node 17 changes and the voltage difference between the first node 17 and the voltage stabilizing target 14 meets the turn-on condition of the third switching element 22, the third switching element 22 may be controlled to be turned on.

In S72*c*, when the second switching element 13 is turned on and the third switching element 22 is turned on, the first switching element 12 may be controlled to be turned off.

In one embodiment, when the second switching element 13 is turned on, the voltage at the control terminal of the first switching element 12 may change. When the voltage difference between the control terminal of the first switching element 12 and the voltage stabilizing target 14 meets the turn-off condition of the first switching element 12, the first switching element 12 may be controlled to be turned off. As such, the first voltage stabilizing element 11 may be disconnected from the voltage stabilizing target 14.

When the third switching element 22 is turned on, the second voltage stabilizing element 21 may be connected to the voltage stabilizing target 14. As such, the second voltage stabilizing element 21 may replace the first voltage stabilizing element 11 to stabilize the voltage of the voltage stabilizing target 14.

In the above embodiment, when the first voltage stabilizing element 11 is in a current surge state, controlling the first switching element 12 to be turned off can disconnect the first voltage stabilizing element 11 from the voltage stabilizing target 14. In addition, the third switching element 22 may be controlled to be turned on, and thus the second voltage stabilizing element 21 may be connected to the voltage stabilizing target 14. As such, the second voltage stabilizing element 21 may replace the first voltage stabilizing element 11 to stabilize the voltage of the voltage stabilizing target 14.

In some embodiments, the voltage stabilization method may further include the following exemplary steps.

In S71*d*, when the first voltage stabilizing element 11 is in a current surge state, the second switching element 13 and the third switching element 22 may be controlled to be turned semi-on.

In one embodiment, when the first voltage stabilizing element 11 is in a current surge state, the voltage across the two terminals of the first voltage stabilizing element 11 may drop to a certain extent. Because the first node 17 is arranged at the first terminal of the first voltage stabilizing element 11, the voltage at the first node 17 may also drop accordingly. When the voltage difference between the first node 17 and the second signal input terminal 16 meets the semi-on condition of the second switching element 13, the second switching element 13 may be turned semi-on. In addition, when the voltage difference between the first node 17 and the voltage stabilizing target 14 meets the semi-on condition of the third switching element 22, the third switching element 22 may be controlled to be turned semi-on.

In S72*d*, when the second switching element 13 and the third switching element 22 are semi-on, the first switching element 12 may be controlled to be turned semi-off. As such, the first voltage stabilizing element 11 may be connected to the voltage stabilizing target 14, and the second voltage stabilizing element 21 may be connected to the voltage stabilizing target 14.

In one embodiment, when the second switching element 13 is in the semi-on state, the voltage of the control terminal at the first switching element 12 may change. When the voltage difference between the control terminal of the first switching element 12 and the voltage stabilizing target 14 meets the semi-off condition of the first switching element 12, the first switching element 12 may be turned semi-off. As such, the first voltage stabilizing element 11 may not be completely disconnected from the voltage stabilizing target 14. When the third switching element 22 is in the semi-on state, the second voltage stabilizing element 21 may be controlled to be connected with the voltage stabilizing target. As such, the second voltage stabilizing element 21 and the first voltage stabilizing element 11 may jointly stabilize the voltage of the voltage stabilizing target 14.

In the above embodiment, when the first voltage stabilizing element 11 is in a current surge state, the second switching element 13 may be turned semi-on, the first switching element 12 may be turned semi-off, and the third switching element 22 may be turned semi-on. As such, the second voltage stabilizing element 21 may bear part of the pulse current received by the first voltage stabilizing element 11. Therefore, the impact strength of the pulse current on the first voltage stabilizing element 11 may be reduced, and the recovery time of the first voltage stabilizing element may be shortened. As such, the use of the disclosed voltage stabilization circuit may be able to improve the pulse current resistance of the first voltage stabilizing element.

In some embodiments, in order to ensure that the voltage stabilization circuit can operate normally when the first voltage stabilizing element impacted by pulses is restored to the second operating state, the voltage stabilization method may further include the following exemplary steps.

When the first voltage stabilizing element 11 is switched from the current-surge operating state to the second operating state, the first switching element 12 may be controlled to be turned on, the second switching element 13 may be controlled to be turned off, and the third switching element 22 may be controlled to be turned off. As such, the first voltage stabilizing element 11 may be connected to the voltage stabilizing target through the first switching element 12, and the second voltage stabilizing element 21 may be disconnected from the voltage stabilizing target.

In some embodiments, in order to improve the ESD resistance of the voltage stabilization circuit, the voltage stabilization method may further include controlling the voltage at the second signal input terminal 16 and adjusting the intensity of the pulse current that the first voltage stabilizing element 11 can withstand.

In one embodiment, when the first voltage stabilizing element 11 is impacted by a pulse current of a certain intensity, the voltage across the two terminals may change, resulting in a change in the voltage at the first node 17. The conduction state of the second switching element 13 may be determined due to the voltage difference between the first node 17 and the second signal input terminal 16. Therefore, by adjusting the voltage at the second signal input terminal 16, the intensity of the pulse current that the first voltage stabilizing element 11 can withstand may be increased. As such, the ESD resistance of the voltage stabilization circuit may be improved.

In addition, in the voltage stabilization circuit, the ESD resistance of the voltage stabilizing element can be adjusted, thereby balancing the ESD resistance of the stabilizing element and the panel. As such, the ESD resistance of the entire module may be improved.

Figure 8:
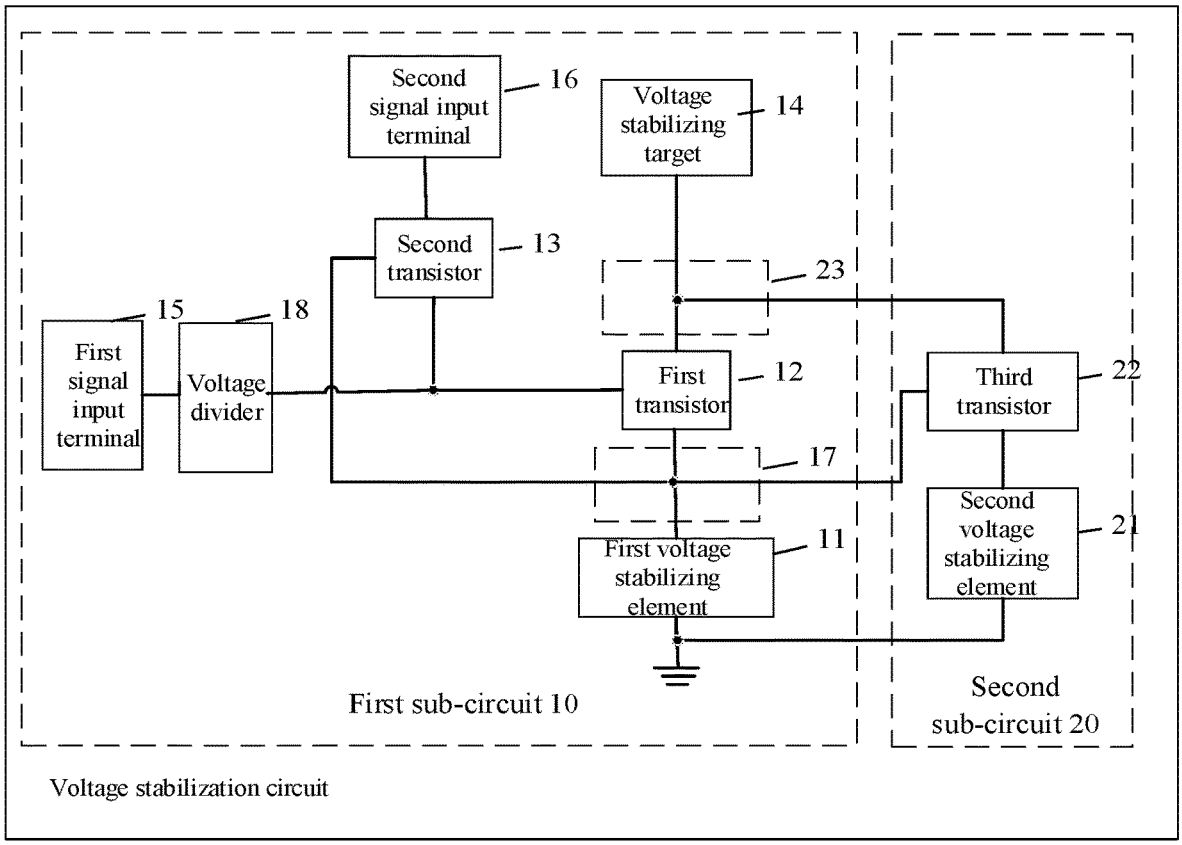
FIG. 8 illustrates a schematic structural diagram of another exemplary voltage stabilization circuit including a second sub-circuit according to an embodiment of the present disclosure.

FIG. 8 illustrates a schematic structural diagram of another exemplary voltage stabilization circuit including a second sub-circuit according to an embodiment of the present disclosure. Referring to FIG. 8, the voltage stabilization circuit may include a first circuit 10 and a second circuit 20. In the first sub-circuit 10, the first switching element 12 may include a first transistor Q1, and the second switching element 13 may include a second transistor Q2. In the second sub-circuit 20, the third switching element 22 may include a third transistor Q3. In various embodiments of the present disclosure, the types of the first transistor Q1 and the second transistor Q2 are not limited. For example, the first transistor Q1, the second transistor Q2, and the third transistor Q3 may be P-type transistors or N-type transistors.

It should be noted that the structure of the first sub-circuit is the same as the structure of the first sub-circuit in the embodiment described above, and will not be repeated here.

The first terminal of the second voltage stabilizing element 21 may be electrically connected to the first terminal of the third transistor Q3, and the second terminal of the second voltage stabilizing element 21 may be grounded.

The control terminal of the third transistor Q3 may be electrically connected to the first node 17 of the first sub-circuit 10, and the second terminal of the third transistor Q3 may be electrically connected to the second node 23. The second node 23 may include a node between the second terminal of the first transistor Q1 and the voltage stabilizing target 14.

In one embodiment, because the second voltage stabilizing element 21 is connected to the voltage stabilizing target 14 through the third transistor Q3, when the third transistor Q3 is turned on, the second voltage stabilizing element 21 may be connected to the voltage stabilizing target 14 through the third transistor Q3. When the third transistor Q3 is turned off, the second voltage stabilizing element 21 may be disconnected from the voltage stabilizing target 14.

In one embodiment, the control terminal of the third transistor Q3 may be electrically connected to the first node 17, that is, the control terminal of the third transistor Q3 may be electrically connected to the first terminal of the first voltage stabilizing element 11 in the first sub-circuit 10, and also electrically connected to the first sub-circuit 10. Therefore, the operating state of the first voltage stabilizing element 11 in the first sub-circuit 10 can affect the conduction state of the third transistor Q3.

In one embodiment, the conduction state of the third transistor Q3 may include on, semi-on, off, and semi-off. It should be noted that semi-on refers to incomplete on, and semi-off refers to incomplete off.

In the above embodiment, the second sub-circuit including the second voltage stabilizing element and the third transistor may form a supplementary circuit for the first sub-circuit, such that when the first sub-circuit cannot implement the voltage stabilization function, the second sub-circuit may be able to replace the first sub-circuit to implement the voltage stabilization function.

Figure 9:
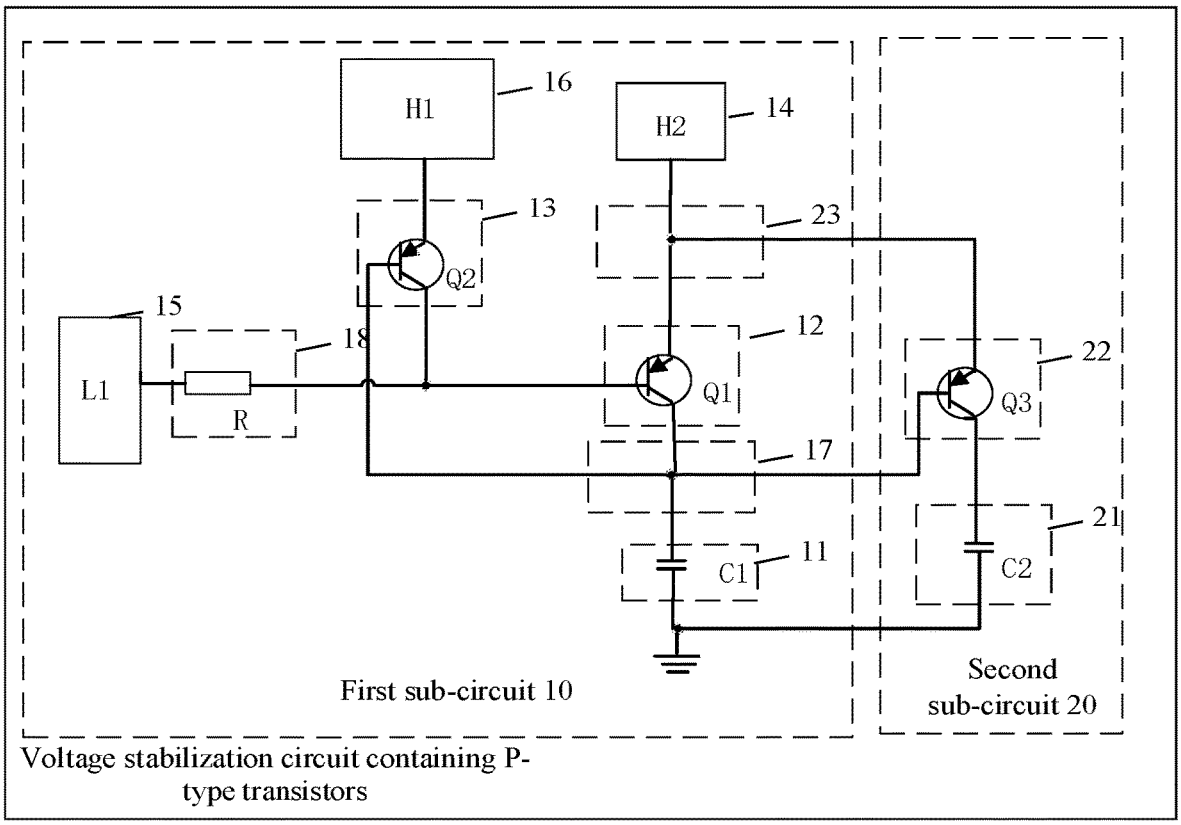
FIG. 9 illustrates a schematic structural diagram of another exemplary voltage stabilization circuit including a P-type transistor according to an embodiment of the present disclosure.

FIG. 9 illustrates a schematic structural diagram of another exemplary voltage stabilization circuit including a P-type transistor according to an embodiment of the present disclosure. Referring to FIG. 9, in one embodiment, the first transistor Q1, the second transistor Q2, and the third transistor Q3 may all be P-type transistors. Because a P-type transistor is turned on when the voltage difference between the gate and the second terminal of the transistor is less than the threshold voltage, the conduction through the P-type transistor can also be understood as low-level conduction (e.g., the P-type transistor may be a low-level on transistor).

In one embodiment, the first signal input terminal 15 may be a negative voltage input terminal, and the second signal input terminal 16 may be a positive voltage input terminal. The voltage stabilizing target 14 may be a positive voltage operating signal.

Because the element connection relationship of the first transistor Q1 and the second transistor Q2 is the same as the element connection relationship of the first transistor Q1 and the second transistor Q2 described in any of the embodiments of the present disclosure, for brevity, the details are not repeated here.

It should be noted that in the embodiments of the present disclosure, the control terminal of a transistor is the gate of the transistor.

In one embodiment, the first terminal of the second voltage stabilizing element 21 may be electrically connected to the first terminal of the third transistor Q3, and the second terminal of the second voltage stabilizing element 21 may be grounded.

The gate of the third transistor Q3 may be electrically connected to the first node 17 of the first sub-circuit 10, and the second terminal of the third transistor Q3 may be electrically connected to the second node 23. The second node 23 may include a node between the second terminal of the first transistor Q1 and the voltage stabilizing target 14.

In one embodiment, because the second voltage stabilizing element 21 is connected to the voltage stabilizing target 14 through the third transistor Q3, when the third transistor Q3 is turned on, the second voltage stabilizing element 21 can be connected to the voltage stabilizing target 14 through the third transistor Q3. When the third transistor Q3 is turned off, the second voltage stabilizing element 21 may be disconnected from the voltage stabilizing target 14.

In one embodiment, the gate of the third transistor Q3 may be electrically connected to the first node 17, that is, the gate of the third transistor Q3 may be electrically connected to the first terminal of the first voltage stabilizing element 11 in the first sub-circuit 10, and also electrically connected to the first terminal of the first transistor Q1 in the first sub-circuit 10. Therefore, the operating state of the first voltage stabilizing element 11 in the first sub-circuit 10 can affect the conduction state of the third transistor Q3.

In one embodiment, the conduction state of the third transistor Q3 may include on, semi-on, off, and semi-off. It should be noted that semi-on refers to incomplete on, and semi-off refers to incomplete off.

In the above embodiment, the second sub-circuit including the second voltage stabilizing element and the third transistor may form a supplementary circuit for the first sub-circuit, such that when the first sub-circuit cannot implement the voltage stabilization function, the second sub-circuit may be able to replace the first sub-circuit to implement the voltage stabilization function.

Figure 11:
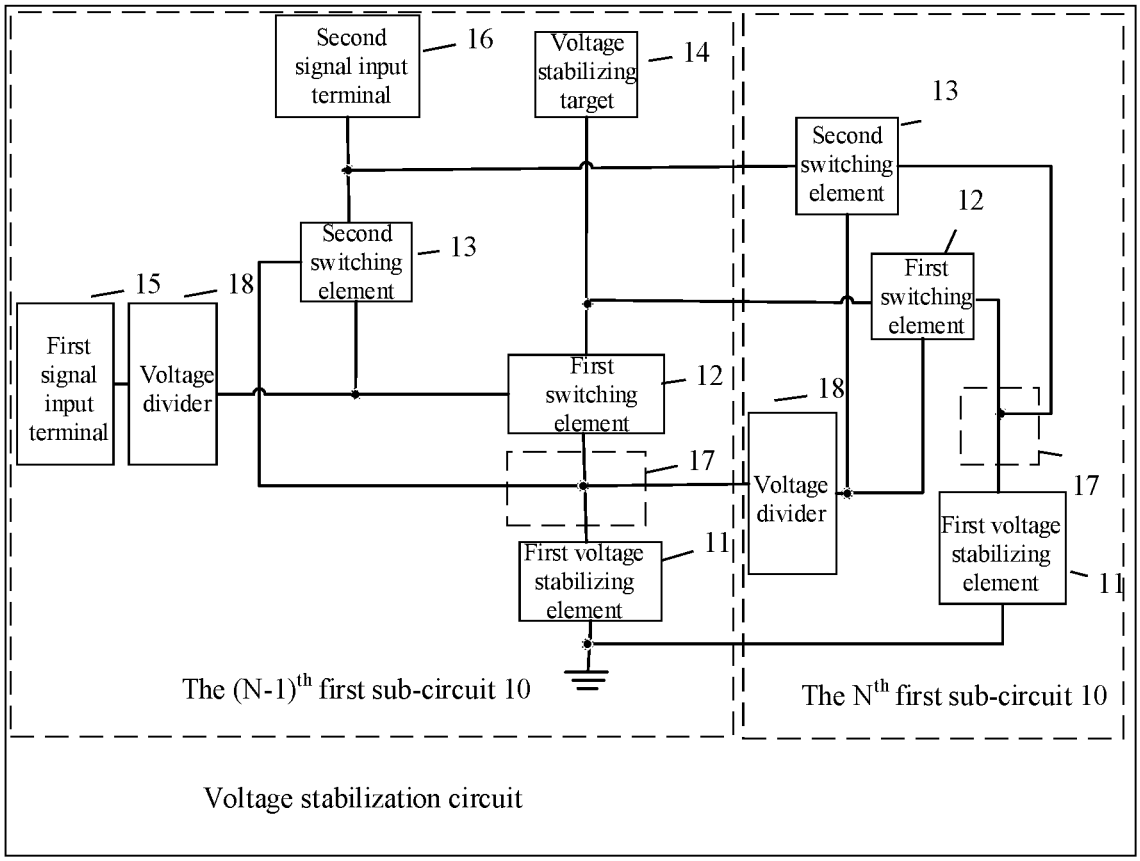
FIG. 11 illustrates a schematic structural diagram of an exemplary multi-stage voltage stabilization circuit according to an embodiment of the present disclosure.

In some embodiments, in order to ensure that the first transistor Q1 can be turned off normally when the first voltage stabilizing element is in the first operating state, as shown in FIG. 11, the first sub-circuit 10 may also include a voltage divider 18.

One terminal of the voltage divider 18 may be electrically connected to a node between the gate of the first transistor Q1 and the first terminal of the second transistor Q2. In one embodiment, the other terminal of the voltage divider 18 may be electrically connected to the negative voltage input terminal.

In one embodiment, when the first voltage stabilizing element is in the first operating state, the second transistor Q2 may be turned on. In order to avoid potential competition between the first terminal of the second transistor Q2 and the negative voltage input terminal causing the first transistor Q1 unable to be turned off normally, a voltage divider 18 may be disposed between the negative voltage input terminal and the first terminal of the second transistor Q2.

In some embodiments, the voltage divider 18 may include a resistor R.

In some embodiments, the first voltage stabilizing element 11 may include a first capacitor C1, and the second voltage stabilizing element 21 may include a second capacitor C2.

It should be noted that, in various embodiments of the present disclosure, the first voltage stabilizing element 11 may include, but is not limited to, a capacitor. For example, the first voltage stabilizing element 11 may be one or more of electronic elements such as a diode, a transient diode, and a varistor.

The present disclosure also provides another voltage stabilization method, and the voltage stabilization method may include the following exemplary steps.

In S81, a negative voltage signal may be inputted into a negative voltage input terminal, a first positive voltage signal may be inputted into a positive voltage input terminal, and a second positive voltage signal may be inputted into a voltage stabilizing target.

In one embodiment, the negative voltage signal may be the turn-on voltage L1 of a first transistor Q1, and the first positive voltage signal may be the turn-off voltage H1 of the first transistor Q1. The second positive voltage signal may be an operating signal H2. The turn-on voltage L1 may be a negative voltage signal, and the turn-off voltage H1 and the operating signal H2 may be positive voltage signals.

In some embodiments, the voltage stabilization method may further include the following exemplary steps.

In S82*a*, when a first capacitor C1 is in a first operating state and a second capacitor C2 is in a second operating state, based on the turn-off voltage H1 and the operating signal H2, and because a first node 17 is connected to the ground through the first capacitor C1, a second transistor Q2 and a third transistor Q3 may be controlled to be turned on. As such, the second capacitor C2 may be connected with the voltage stabilizing target.

In one embodiment, the first operating state may include a short-circuit operating state. When the first capacitor C1 is in the short-circuit operating state, because the first node 17 is connected to the ground through the first capacitor C1, the voltage at the first node 17 may decrease. Because the first node 17 is electrically connected to the gate of the second transistor Q2, when the voltage difference between the voltage at the first node 17 and the turn-off voltage H1 is less than the threshold voltage of the second transistor Q2, the second transistor Q2 may be controlled to be turned on. In addition, when the voltage difference between the first node 17 and the operating signal H2 is less than the threshold voltage of the third transistor Q3, the third transistor Q3 may be controlled to be turned on.

In S83*a*, based on the second transistor Q2 being turned on, the first transistor Q1 may be controlled to be turned off, such that the first capacitor C1 may be disconnected from the operating signal H2.

In one embodiment, because the second transistor Q2 is turned on, the turn-off voltage H1 may be transmitted to the gate of the first transistor Q1 through the second transistor Q2. When the voltage difference between the gate of the first transistor Q1 and the operating signal H2 is greater than the threshold voltage of the first transistor Q1, the first transistor Q1 may be controlled to be turned off. Because the first capacitor C1 is connected to the operating signal H2 through the first transistor Q1, when the first transistor Q1 is turned off, the first capacitor C1 may be disconnected from the operating signal H2.

In the above embodiment, when the first voltage stabilizing element is in an abnormal operating state, the second transistor Q2 and the third transistor Q3 may be controlled to be turned on, and the first transistor Q1 may be turned off. As such, the first voltage stabilizing element 11 may be disconnected from the voltage stabilizing target 14, and the second voltage stabilizing element 21 may be connected to the voltage stabilizing target 14. Therefore, when the first voltage stabilizing element 11 in the first sub-circuit fails to operate, the second voltage stabilizing element 21 may replace the first voltage stabilizing element 11 to stabilize the voltage of the voltage stabilizing target 14.

In some embodiments, in order to ensure that the voltage stabilization circuit can operate normally, the voltage stabilization method may further include the following exemplary steps.

In S82*b*, when the first capacitor C1 is in the second operating state, the first transistor Q1 may be controlled to be turned on based on the turn-on voltage L1 and the operating signal H2.

In one embodiment, when the first capacitor C1 is in a normal operating state, the starting voltage L1 may be transmitted to the gate of the first transistor Q1, and the voltage difference between the gate of the first transistor Q1 and the operating signal H2 is less than the threshold voltage of the first transistor Q1, and thus the first transistor Q1 may be controlled to be turned on. When the first transistor Q1 is turned on, the first capacitor C1 may be connected with the operating signal H2 through the first transistor Q1, such that the first capacitor C1 may stabilize the voltage of the operating signal H2.

In S83*b*, based on the first transistor Q1 being turned on, the second transistor Q2 and the third transistor Q3 may be controlled to be turned off.

In one embodiment, because the first transistor Q1 is turned on, the operating signal H2 may be transmitted to the first node through the first transistor Q1. The voltage difference between the first node 17 and the turn-off voltage H1 may be greater than the threshold voltage of the second transistor Q2, and thus the second transistor Q2 may be controlled to be turned off. When the first transistor Q1 is turned on, the voltage difference between the first node 17 and the operating signal H2 may be greater than the threshold voltage of the third transistor Q3, and thus the third transistor Q3 may be controlled to be turned off. As such, the second capacitor C2 may be disconnected from the operating signal H2, and the second capacitor C2 may be suspended.

In some embodiments, the voltage stabilization method may further include the following exemplary steps.

In S82*c*, when the first capacitor C1 is in a current surge state, based on the voltage drop of the first capacitor C1 and the voltage drop of the first node, the second transistor Q2 and the third transistor Q3 may be controlled to be turned on.

In one embodiment, when the first capacitor C1 is in a current surge state, the voltage across the first capacitor C1 may drop to a certain extent. Because the first node 17 is arranged at the first terminal of the first capacitor C1, the voltage at the first node 17 may also drop accordingly. When the voltage difference between the first node 17 and the turn-off voltage H1 is less than the threshold voltage of the second transistor Q2, the second transistor Q2 may be controlled to be turned on. Because the first node 17 is electrically connected to the gate of the third transistor Q3, when the voltage difference between the first node 17 and the operating signal H2 is less than the threshold voltage of the third transistor Q3, the third transistor Q3 may be controlled to be turned on. As such, the second capacitor C2 may be connected with the operating signal H2.

In S83*c*, based on the second transistor Q2 being turned on, the first transistor Q1 may be controlled to be turned off.

In one embodiment, because the second transistor Q2 is turned on, the turn-off voltage H1 may be transmitted to the gate of the first transistor Q1 through the second transistor Q2. When the voltage difference between the gate of the first transistor Q1 and the operating signal H2 is greater than the threshold voltage of the first transistor Q1, the first transistor Q1 may be controlled to be turned off.

In the above embodiment, when the first capacitor C1 is in a current surge state, the first transistor Q1 may be controlled to be turned off, which can disconnect the first capacitor C1 from the operating signal H2, thereby avoiding the first capacitor C1 in an abnormal operating state from affecting the output of the operating signal H2. In addition, the third transistor Q3 may be controlled to be turned on, so that the second capacitor C2 may be connected to the operating signal H2. As such, the second capacitor C2 may replace the first capacitor C1 to stabilize the voltage of the operating signal H2.

In some embodiments, the voltage stabilization method may further include the following exemplary steps.

In S82*d*, when the first capacitor C1 is in a current surge state, based on the voltage drop of the first capacitor C1 and the voltage drop of the first node, the second transistor Q2 and the third transistor Q3 may be controlled to be turned semi-on.

In one embodiment, when the first capacitor C1 is in a current surge state, the voltage across the first capacitor C1 may drop to a certain extent. Because the first node 17 is arranged at the first terminal of the first capacitor C1, the voltage of the first node 17 may also drop accordingly. When the voltage difference between the first node 17 and the turn-off voltage H1 is less than the threshold voltage of the second transistor Q2, the second transistor Q2 may be controlled to be turned semi-on. Because the first node 17 is electrically connected to the gate of the third transistor Q3, when the voltage difference between the first node 17 and the operating signal H2 is less than the threshold voltage of the third transistor Q3, the third transistor Q3 may be controlled to be turned semi-on. As such, the second capacitor C2 may be connected with the operating signal H2.

In S83, based on the second transistor Q2 being turned semi-on, the first transistor Q1 may be controlled to be turned semi-off.

In one embodiment, because the second transistor Q2 is semi-on, the turn-off voltage H1 may be transmitted to the gate of the first transistor Q1 through the second transistor Q2. When the voltage difference between the gate of the first transistor Q1 and the operating signal H2 is greater than the threshold voltage of the first transistor Q1, the first transistor Q1 may be controlled to be turned semi-off.

In the above embodiment, when the first capacitor C1 is in a current surge state, the second transistor Q2 may be turned semi-on, the first transistor Q1 may be turned semi-off, and the third transistor Q3 may be turned semi-on. As such, the second capacitor C2 may bear part of the pulse current received by the first capacitor C1. Therefore, the impact strength of the pulse current on the first capacitor C1 may be reduced, and the recovery time of the first capacitor C1 may be shortened. As such, the use of the disclosed voltage stabilization circuit may be able to improve the pulse current resistance of the first capacitor C1.

In some embodiments, in order to ensure that the voltage stabilization circuit can operate normally when the first voltage stabilizing element impacted by pulses is restored to the second operating state, the voltage stabilization method may further include the following exemplary steps.

When the first capacitor C1 is switched from current-surge operating state to the second operating state, the first transistor Q1 may be turned on, the second transistor Q2 may be turned off, and the third transistor Q3 may be turned off. As such, the first capacitor C1 may be connected with the operating signal H2 through the first transistor Q1, and the second capacitor C2 may be disconnected from the operating signal H2.

In some embodiments, in order to improve the ESD resistance of the voltage stabilization circuit, the voltage stabilization method may further include controlling the value of the turn-off voltage H1 and adjusting the intensity of the pulse current that the first capacitor C1 can withstand.

Figure 10:
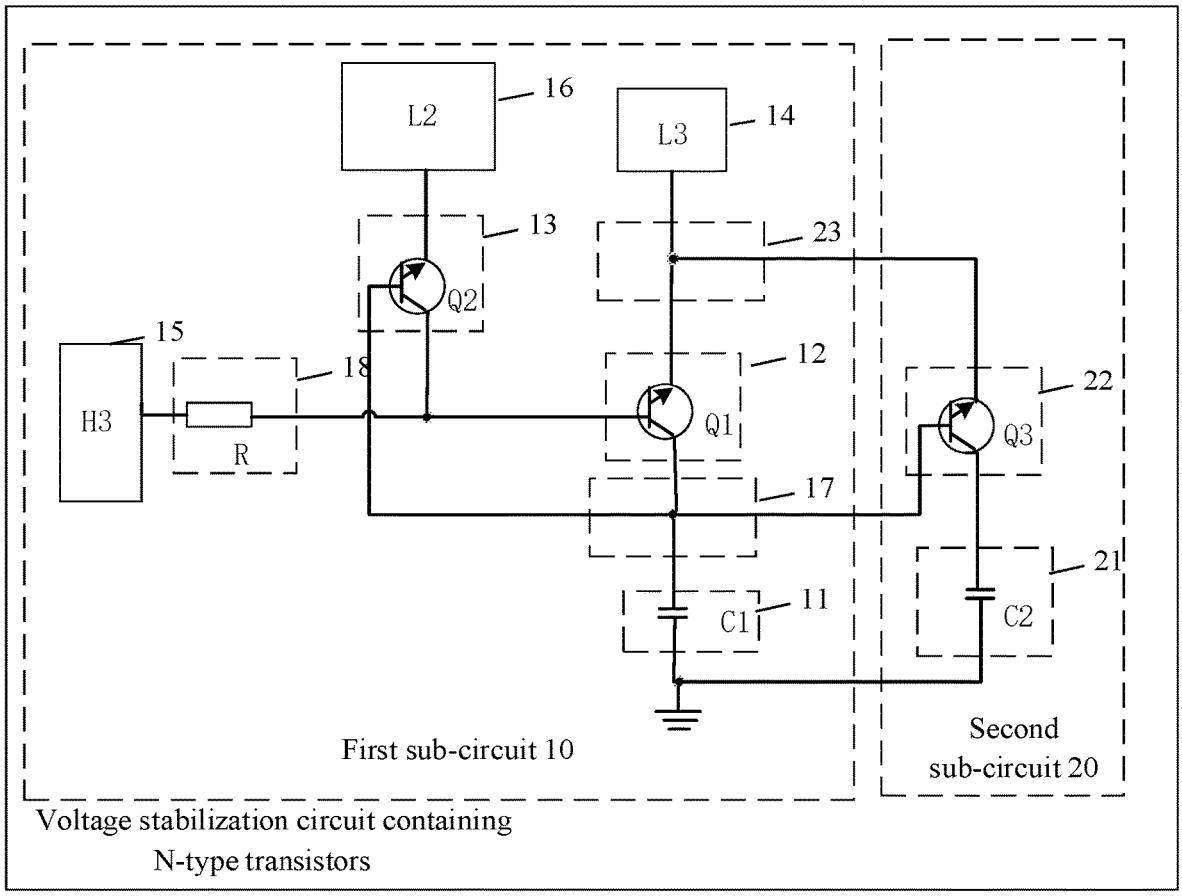
FIG. 10 illustrates a schematic structural diagram of another exemplary voltage stabilization circuit including an N-type transistor according to an embodiment of the present disclosure.

FIG. 10 illustrates a schematic structural diagram of another exemplary voltage stabilization circuit including an N-type transistor according to an embodiment of the present disclosure. Referring to FIG. 10, in one embodiment, the first transistor Q1, the second transistor Q2, and the third transistor Q3 may all be N-type transistors.

In one embodiment, the first signal input terminal 15 may be a positive voltage input terminal, and the second signal input terminal 16 may be a negative voltage input terminal. The voltage stabilizing target 14 can be an operating signal of a negative voltage.

Because the connection relationship between the third transistor and other elements is similar to the connection relationship between the third transistor and other elements in the embodiment described above, for brevity, the details are not repeated here.

In some embodiments, in order to ensure that the first transistor Q1 can be turned off normally, as shown in FIG. 10, the first sub-circuit 10 may include a voltage divider 18.

One terminal of the voltage divider 18 may be electrically connected to a node between the gate of the first transistor Q1 and the first terminal of the second transistor Q2. The other terminal of the voltage divider 18 may be electrically connected to the negative voltage input terminal.

In some embodiments, referring to FIG. 10, the first voltage stabilizing element 11 may include a first capacitor C1, and the second voltage stabilizing element 21 may include a second capacitor C2.

It should be noted that in the present disclosure, the first voltage stabilizing element may include, but is not limited to, a capacitor. For example, the first voltage stabilizing element may be one or more of electronic elements such as a diode, a transient diode, and a varistor.

The present disclosure also provides another voltage stabilization method, which can be applied to the voltage stabilization circuit shown in FIG. 10. The voltage stabilization method may include the following exemplary steps.

In S91, a positive voltage signal may be inputted into a positive voltage input terminal, a first negative voltage signal may be inputted into a negative voltage input terminal, and a second negative voltage signal may be inputted into a voltage stabilizing target.

In one embodiment, the positive voltage signal may be a turn-on voltage H3 of a first transistor Q1, and the first negative voltage signal may be a turn-off voltage L2 of the first transistor Q1. The second negative voltage signal may be the operating signal L3. The turn-on voltage H3 may be a positive voltage signal, the turn-off voltage L2 and the operating signal L3 may be negative voltage signals.

In some embodiments, the voltage stabilization method may further include the following exemplary steps.

In S92*a*, when the first capacitor C1 is in a first operating state, and the second capacitor C2 is in a second operating state, based on the turn-off voltage L2 and because the first node is connected with the ground through the first capacitor C1, the second transistor Q2 and the third transistor Q3 may be controlled to be turned on, such that the second capacitor C2 may be connected with the voltage stabilizing target 14.

In one embodiment, the first operating state may include a short-circuit operating state. When the first capacitor C1 is in the short-circuit operating state, because the first node 17 is connected to the ground through the first capacitor C1, the voltage at the first node 17 may decrease. Because the first node 17 is electrically connected to the gate of the second transistor Q2, when the voltage difference between the voltage at the first node 17 and the turn-off voltage L2 is greater than the threshold voltage of the second transistor Q2, the second transistor Q2 may be controlled to be turned on. In addition, when the voltage difference between the voltage at the first node 17 and the operating voltage L3 is greater than the threshold voltage of the third transistor Q3, the third transistor Q3 may be controlled to be turned on.

In S93*a*, based on the second transistor Q2 being turned on, the first transistor Q1 may be controlled to be turned off, such that the first capacitor C1 may be disconnected from the operating signal L3.

In one embodiment, because the second transistor Q2 is turned on, the turn-off voltage L2 may be transmitted to the gate of the first transistor Q1 through the second transistor Q2. When the voltage difference between the gate of the first transistor Q1 and the operating signal L3 is less than the threshold voltage of the first transistor Q1, the first transistor Q1 may be controlled to be turned off. Because the first capacitor C1 is connected to the operating signal H2 through the first transistor Q1, when the first transistor Q1 is turned off, the first capacitor C1 may be disconnected from the operating signal L3.

In the above embodiment, when the first capacitor C1 is in an abnormal operating state, the second transistor Q2 and the third transistor Q3 may be controlled to be turned on, and the first transistor Q1 may be turned off. As such, the first capacitor C1 may be disconnected from the operating signal L3 in the first sub-circuit, and the second capacitor C2 may be connected to the operating signal L3. Therefore, when the first capacitor C1 in the first sub-circuit fails to operate, the second capacitor C2 may replace the first capacitor C1 to stabilize the voltage of the voltage stabilizing target 14

In some embodiments, in order to ensure the voltage stabilization circuit can operate normally, the voltage stabilization method may further include the following exemplary steps.

In S92*b*, when the first capacitor C1 is in the second operating state, the first transistor Q1 may be controlled to be turned on based on the turn-on voltage H3 and the operating signal L3.

In one embodiment, when the first capacitor C1 is in a normal operating state, the turn-on voltage H3 may be transmitted to the gate of the first transistor Q1, the voltage difference between the gate of the first transistor Q1 and the operating signal L3 may be greater than the threshold voltage of the first transistor Q1, and the first transistor Q1 may be controlled to be turned on. When the first transistor Q1 is turned on, the first capacitor C1 may be connected to the operating signal L3 through the first transistor Q1. As such, the first capacitor C1 may be able to stabilize the voltage of the operating signal L3.

In S93*b*, based on the first transistor Q1 being turned on, the second transistor Q2 and the third transistor Q3 may be controlled to be turned off.

In one embodiment, because the first transistor Q1 is turned on, the operating signal L3 may be transmitted to the first node 17 through the first transistor Q1, the voltage difference between the first node 17 and the turn-off voltage L2 may be smaller than the threshold voltage of the second transistor Q2, and the second transistor Q2 may be controlled to be turned off. When the first transistor Q1 is turned on and the voltage difference between the first node 17 and the operating signal L3 is less than the threshold voltage of the third transistor Q3, the third transistor Q3 may be controlled to be turned off. As such, the second capacitor C2 may be disconnected from the operating signal L3, and the second capacitor C2 may be suspended.

In some embodiments, the voltage stabilization method may further include the following exemplary steps.

In S92*c*, when the first capacitor C1 is in a current surge state, based on the voltage increase of the first capacitor C1 and the voltage increase of the first node, the second transistor Q2 and the third transistor Q3 may be controlled to be turned on.

In one embodiment, when the first capacitor C1 is in a current surge state, the voltage across the first capacitor C1 may increase to a certain extent. Because the first node 17 is arranged at the first terminal of the first capacitor C1, the voltage at the first node 17 may also increase accordingly. When the voltage difference between the first node 17 and the turn-off voltage L2 is greater than the second transistor Q2, the second transistor Q2 may be controlled to be turned on. Because the first node 17 is electrically connected to the gate of the third transistor Q3, when the voltage difference between the first node 17 and the operating signal L3 is greater than the threshold voltage of the third transistor Q3, the third transistor Q3 may be controlled to be turned on. As such, the second capacitor C2 may be connected with the operating signal L3.

In S93*c*, based on the second transistor Q2 being turned on, the first transistor Q1 may be controlled to be turned off.

In one embodiment, because the second transistor Q2 is turned on, the turn-off voltage L2 may be transmitted to the gate of the first transistor Q1 through the second transistor Q2. When the voltage difference between the gate of the first transistor Q1 and the operating signal L3 is less than the threshold voltage of the first transistor Q1, the first transistor Q1 may be controlled to be turned off.

In the above embodiment, when the first capacitor C1 is in the current surge state, the first transistor Q1 may be controlled to be turned off, which can disconnect the first capacitor C1 from the operating signal L3, thereby avoiding the first capacitor C1 in an abnormal operating state from affecting the output of the operating signal L3. In addition, the third transistor Q3 may be controlled to be turned on, so that the second capacitor C2 may be connected to the operating signal L3. As such, the second capacitor C2 may replace the first capacitor C1 to stabilize the voltage of the operating signal L3.

In some embodiments, the voltage stabilization method may further include the following exemplary steps.

In S92*d*, when the first capacitor C1 is in a current surge state, based on the voltage increase of the first capacitor C1 and the voltage increase of the first node, the second transistor Q2 and the third transistor Q3 may be controlled to be turned semi-on.

In one embodiment, when the first capacitor C1 is in a current surge state, the voltage across the first capacitor C1 may increase to a certain extent. Because the first node 17 is arranged at the first terminal of the first capacitor C1, the voltage of the first node 17 may also increase accordingly. When the voltage difference between the first node 17 and the turn-off voltage L2 is greater than the second transistor Q2, the second transistor Q2 may be controlled to be turned semi-on. Because the first node 17 is electrically connected to the gate of the third transistor Q3, when the voltage difference between the first node 17 and the operating signal L3 is greater than the threshold voltage of the third transistor Q3, the third transistor Q3 may be controlled to be turned semi-on. As such, the second capacitor C2 may be connected with the operating signal L3.

In S93*d*, based on the second transistor Q2 being semi-on, the first transistor Q1 may be controlled to be turned semi-off.

In one embodiment, because the second transistor Q2 is semi-on, the turn-off voltage L2 may be transmitted to the gate of the first transistor Q1 through the second transistor Q2. When the voltage difference between the gate of the first transistor Q1 and the operating signal L3 is less than the threshold voltage of the first transistor Q1, the first transistor Q1 may be controlled to be turned semi-off.

In the above-embodiment, when the first capacitor C1 is in a current surge state, the second transistor Q2 may be turned semi-on, the first transistor Q1 may be turned semi-off, and the third transistor Q3 may be turned semi-on. As such, the second capacitor C2 can bear part of the pulse current received by the capacitor C1. Therefore, the impact strength of the pulse current on the first capacitor C1 may be reduced, and the recovery time of the first capacitor C1 may be shortened. As such, the use of the disclosed voltage stabilization circuit may be able to improve the pulse current resistance of the first capacitor C1.

In some embodiments, in order to ensure that the voltage stabilization circuit can operate normally when the first voltage stabilizing element impacted by pulses is restored to the second operating state, the voltage stabilization method may further include the following exemplary steps.

When the first capacitor C1 is switched from current-surge operating state to the second operating state, the first transistor Q1 may be turned on, the second transistor Q2 may be turned off, and the third transistor Q3 may be turned off. As such, the first capacitor C1 may be connected with the operating signal L3 through the first transistor Q1, and the second capacitor C2 may be disconnected from the operating signal L3.

In some embodiments, in order to improve the ESD resistance of the voltage stabilization circuit, the voltage stabilization method may further include controlling the value of the turn-off voltage L2 and adjusting the intensity of the pulse current that the first capacitor C1 can withstand.

FIG. 11 illustrates a schematic structural diagram of an exemplary multi-stage voltage stabilization circuit according to an embodiment of the present disclosure. Referring to FIG. 11, in one embodiment, in order to ensure that the voltage stabilization circuit achieves the effect of replacing the stabilizing element and automatically terminating the replaced stabilizing element, the voltage stabilization circuit may include M first sub-circuits 10, where M is an integer greater than 1. Each first sub-circuit 10 may include a first voltage stabilizing element 11, a first switching element 12, and a second switching element 13. Because the internal connection structure of the first sub-circuit 10 is the same as the internal connection structure of the first sub-circuit in various embodiments described above, for brevity, the details are not repeated here.

In one embodiment, in the $N^{th}$ first sub-circuit, where N is an integer and $1 \leq N \leq M$, the first terminal of the first voltage stabilizing element 11 may be electrically connected to the first terminal of the first switching element 12, and the second terminal of the first voltage stabilizing element 11 may be grounded.

In the $N^{th}$ first sub-circuit, the control terminal of the first switching element 12 may be electrically connected to the first node 17 in the $(N-1)^{th}$ first sub-circuit, and the second terminal of the first switching element 12 may be electrically connected to the second terminal of the first switching element 12 in the $(N-1)^{th}$ first sub-circuit. The second terminal of the first switching element 12 in the $(N-1)^{th}$ first sub-circuit may be connected to a voltage stabilizing target 14.

In one embodiment, in the $N^{th}$ first sub-circuit, when the first switching element 12 is turned on, the first voltage stabilizing element 11 may be connected with the voltage stabilizing target 14 through the first switching element 12. When the first switching element 12 is turned off, the first voltage stabilizing element 11 may be disconnected from the voltage stabilizing target 14.

In addition, in the $N^{th}$ first sub-circuit, because the control terminal of the first switching element 12 is electrically connected to the first node 17 in the $(N-1)^{th}$ first sub-circuit, the first node 17 in the $(N-1)^{th}$ first sub-circuit may affect the conduction state of the first switching element 12 in the $N^{th}$ first sub-circuit.

In the $N^{th}$ first sub-circuit, the control terminal of the second switching element 13 may be electrically connected to the first node 17, the first terminal of the second switching element 13 may be electrically connected to the control terminal of the first switching element 12, and the second terminal of the second switching element may be electrically connected to the second terminal of the second switching element in the $(N-1)^{th}$ first sub-circuit, and may also be connected to the second signal input terminal 16.

In one embodiment, in the $N^{th}$ first sub-circuit, since the control terminal of the first switching element 12 is connected to the first terminal of the second switching element 13, the conduction state of the second switching element 13 may affect the conduction state of the first switching element 12. Because the control terminal of the second switching element 13 is electrically connected to the first voltage stabilizing element 11, the operating state of the first voltage stabilizing element 11 may affect the conduction state of the second switching element 13.

In the above embodiment, two switching elements and one voltage stabilizing element are used to form the basic structure of the first sub-circuit, such that whether the voltage stabilizing target is disconnected in each first sub-circuit may be determined according to the operating state of the first voltage stabilizing element. As such, the voltage stabilizing target may be ensured to operate normally when the voltage stabilizing element fails to operate normally, thereby reducing the risk of circuit failure. In addition, a plurality of first sub-circuits are used to form a voltage stabilization circuit, so that the operating state of the first voltage stabilizing element in the first sub-circuit of a previous stage controls the conduction state of the switching element of a subsequent stage. As such, the first sub-circuit of the subsequent stage becomes a replacement circuit of the first sub-circuit of the previous stage. When the first sub-circuit of the previous stage cannot implement the voltage stabilization function, the first sub-circuit of the subsequent stage can replace the first sub-circuit of the previous stage to implement the voltage stabilization function.

In some embodiments, in the voltage stabilization circuit shown in FIG. 11, when the first voltage stabilizing element in the $(N-1)^{th}$ first sub-circuit is in the first operating state, and the first voltage stabilizing element in the $N^{th}$ first sub-circuit is in the second operating state, in the $(N-1)^{th}$ first sub-circuit, the second switching element 13 may be turned on and the first switching element 12 may be turned off; and in the $N^{th}$ first sub-circuit, the first switching element 12 may be turned on and the second switching element 13 may be turned off.

In one embodiment, the first operating state may include an abnormal operating state. In the $(N-1)^{th}$ first sub-circuit, because the first voltage stabilizing element 11 is in the abnormal operating state, the voltage across the two terminals of the first voltage stabilizing element 11 may change. That is, when the first voltage stabilizing element 11 is in an abnormal operating state, the voltage at the first node 17 may change. When the voltage difference between the first node 17 and the second signal input terminal 16 meets the turn-on condition of the second switching element 13, the second switching element 13 may be turned on. When the second switching element 13 is turned on, the voltage of the control terminal of the first switching element 12 may change. When the voltage difference between the control terminal of the first switching element 12 and the voltage stabilizing target 14 meets the turn-off condition of the first switching element 12, the first switching element 12 may be turned off. As such, the first voltage stabilizing element 11 may be disconnected from the voltage stabilizing target 14.

In one embodiment, the second operating state may include a normal operating state. In the $N^{th}$ first sub-circuit, when the first voltage stabilizing element 11 is in the normal operating state, the first voltage stabilizing element may isolate direct current, thereby stabilizing the voltage at the first node 17. Therefore, the voltage of the voltage stabilizing target 14 may be stabilized.

In the $N^{th}$ first sub-circuit, the first switching element 12 may be connected to the first node 17 in the $(N-1)^{th}$ first sub-circuit. Therefore, in the case where the first voltage stabilizing element 11 in the $N^{th}$ first sub-circuit is in an abnormal operating state and the voltage at the first node 17 in the $(N-1)^{th}$ first sub-circuit changes, when the voltage difference between the first node 17 in the $(N-1)^{th}$ first sub-circuit and the voltage stabilizing target 14 meets the turn-on condition of the first switching element 12 in the $N^{th}$ first sub-circuit, the first switching element 12 in the $N^{th}$ first sub-circuit may be turned on. As such, the first voltage stabilizing element 11 in the $N^{th}$ first sub-circuit may be connected to the voltage stabilizing target 14 through the first switching element 12.

In addition, in the $N^{th}$ first sub-circuit, the first switching element 12 may be turned on, and when the voltage difference between the first node 17 and the second signal input terminal 16 meets the turn-off condition of the second switching element 13, the second switching element 13 may be turned off, preventing the second switching element 13 from controlling the first switching element 12 to be turned off.

In the above embodiment, in the multi-stage voltage stabilization circuit, when the first sub-circuit of a previous stage fails to operate normally, the first sub-circuit of a subsequent stage may replace the first sub-circuit of the previous stage to operate. As such the situation that the voltage stabilization circuit cannot work normally due to the failure of the voltage stabilizing element may be avoided.

In some embodiments, in the voltage stabilization circuit shown in FIG. 11, when the first voltage stabilizing element in the $(N-1)^{th}$ first sub-circuit is in the second operating state, in the $(N-1)^{th}$ first sub-circuit, the first switching element 12 may be turned on, and the second switching element 13 may be turned off. In the $N^{th}$ first sub-circuit, the first switching element 12 and the second switching element 13 may be turned off.

In one embodiment, in $(N-1)^{th}$ first sub-circuit, the first voltage stabilizing element 11 may be in a normal operating state, and the voltage difference between the voltage stabilizing target 14 and the control terminal of the first switching element 12 may meet the turn-on condition of the first switching element 12, and thus the first switching element 12 may be turned on. The first voltage stabilizing element 11 may be connected to the voltage stabilizing target 14 through the first switching element 12. Therefore, when the first switching element 12 is turned on, the first voltage stabilizing element 11 may be connected with the voltage stabilizing target 14 through the first switching element 12. As such, the first voltage stabilizing element 11 may be able to stabilize the voltage of the voltage stabilizing target 14.

In addition, in the $(N-1)^{th}$ first sub-circuit, when the first switching element 12 is turned on, the voltage difference between the first node 17 and the second signal input terminal 16 may meet the turn-off condition of the second switching element 13, and thus the second switching element 13 may be turned off, preventing the second switching element 13 from controlling the first switching element 12 to turn off.

In one embodiment, in the $(N-1)^{th}$ first sub-circuit, the first switching element 12 may be connected to the first node 17 in the $(N-1)^{th}$ first sub-circuit. Therefore, when the voltage difference between the first node 17 in the $(N-1)^{th}$ first sub-circuit and the voltage stabilizing target 14 meets the turn-off condition of the first switching element 12 in the $N^{th}$ first sub-circuit, the first switching element 12 in the $N^{th}$ first sub-circuit may be turned off, and the first voltage stabilizing element 11 may be suspended.

In addition, in the $N^{th}$ first sub-circuit, because the control terminal of the second switching element 13 is connected to one terminal of the first voltage stabilizing element 11, when the first voltage stabilizing element 11 is suspended, the second switching element 13 may be turned off.

In some embodiments, in the voltage stabilization circuit shown in FIG. 11, when the first voltage stabilizing element in the $(N-1)^{th}$ first sub-circuit is in a first operating state and the first voltage stabilizing element in the $N^{th}$ first sub-circuit is in the first operating state, in the $(N-1)^{th}$ first sub-circuit, the second switching element 13 may be turned on, and the first switching element 12 may be turned off. In the $(N-1)^{th}$ first sub-circuit, the second switching element 13 may be turned on, and the first switching element 12 may be turned off.

In one embodiment, in the $(N-1)^{th}$ first sub-circuit, the first voltage stabilizing element 11 may be in the first operating state. Because the first voltage stabilizing element 11 is in an abnormal operating state, the voltage across the two terminals of the first voltage-stabilizing element 11 may change. That is, when the first voltage stabilizing element 11 is in an abnormal operating state, the voltage at the first node 17 may change. When the voltage difference between the first node 17 and the second signal input terminal 16 meets the turn-on condition of the second switching element 13, the second switching element 13 may be turned on.

When the second switching element 13 is turned on, the voltage at the control terminal of the first switching element 12 may change. When the voltage difference between the control terminal of the first switching element 12 and the voltage stabilizing target 14 meets the turn-off condition of the first switching element 12, the first switching element 12 may be turned off. As such, the first voltage stabilizing element 11 may be disconnected from the voltage stabilizing target 14. Similar to the case where the first voltage stabilizing element 11 in the $(N-1)^{th}$ first sub-circuit is in the first operating state, in the $N^{th}$ first sub-circuit, when the first voltage stabilizing element 11 is in the first operating state, the second switching element 13 may be turned on, and the first switching element 12 may be turned off. As such, the normal operation of the circuit may be ensured when the voltage stabilizing element fails.

In some embodiments, in the voltage stabilization circuit as shown in FIG. 11, when the first voltage stabilizing element in the $(N-1)^{th}$ first sub-circuit is in a current surge state, in the $(N-1)^{th}$ first sub-circuit, the second switching element 13 may be turned on and the first switching element 12 may be turned off; and in the $N^{th}$ first sub-circuit, the first switching element 12 may be turned on, and the second switching element 13 may be turned off.

Alternatively, in the $(N-1)^{th}$ first sub-circuit, the second switching element 13 may be semi-on, and the first switching element 12 may be semi-off. In the $N^{th}$ first sub-circuit, the first switching element 12 may be turned semi-on.

When the first voltage stabilizing element 11 is in the current surge state, because the operation principle of the $(N-1)^{th}$ first sub-circuit is similar to the operation principle of the first sub-circuit in various embodiments described above, for brevity, the details are not repeated here.

In one embodiment, in the $(N-1)^{th}$ first sub-circuit, when the first voltage stabilizing element 11 is in a current surge state, the voltage across the first voltage stabilizing element 11 may change. Because the first node 17 is arranged at the first terminal of the voltage stabilizing element 11, the voltage of the first node 17 may also change accordingly. Because in the $N^{th}$ first sub-circuit, the first switching element 12 may be connected to the first node 17 in the $(N-1)^{th}$ first sub-circuit, when the voltage difference between the first node 17 in the $(N-1)^{th}$ first sub-circuit and the voltage stabilizing target 14 meets the turn-on condition of the first switching element 12 in the $N^{th}$ first sub-circuit, the first switching element 12 in the $N^{th}$ first sub-circuit may be turned on. Alternatively, when the voltage difference between the first node 17 in the $(N-1)^{th}$ first sub-circuit and the voltage stabilizing target 14 meets the semi-on condition of the first switching element 12 in the $N^{th}$ first sub-circuit, the first switching element 12 in the $N^{th}$ first sub-circuit may be turned semi-on.

It should be noted that when the first voltage stabilizing element in the $N^{th}$ first sub-circuit is in the normal operating state, the second switching element in the $N^{th}$ first sub-circuit may be turned off.

In the above embodiment, when the first voltage stabilizing element 11 of a previous stage is in the current surge state, the first switching element of a subsequent stage is controlled to be turned on or semi-on. As such, the voltage stabilizing element in the subsequent stage may bear part of the pulse current received by the voltage stabilizing element 11 of the previous stage. Therefore, the impact strength of the pulse current on the first voltage stabilizing element in the previous stage may be reduced, and the recovery time of the first voltage stabilizing element in the previous stage may be shortened. As such, the use of the disclosed multi-stage voltage stabilization circuits may be able to improve the pulse current resistance of the voltage stabilizing element. In addition, turning the first switching element of the previous stage off may prevent the voltage stabilizing element impacted by the pulse current from affecting the normal operation of the voltage stabilization circuit.

In some embodiments, in the voltage stabilization circuit shown in FIG. 11, when the first voltage stabilizing element 11 in the $(N-1)^{th}$ first sub-circuit is switched from the current-surge operating state to the second operating state, in the $(N-1)^{th}$ first sub-circuit, the first switching element 12 may be turned on, and the second switching element 13 may be turned off. In the $N^{th}$ first sub-circuit, the first switching element 12 may be turned off. As such, the voltage stabilizing element in the previous stage may be reconnected to the voltage stabilizing target.

In some embodiments, in the voltage stabilization circuit shown in FIG. 11, when the first voltage stabilizing element in the $N^{th}$ first sub-circuit is in a current surge state, in the $N^{th}$ first sub-circuit, the first switching element may be turned off and the second switching element 13 may be turned on. Alternatively, the first switching element may be turned semi-off and the second switching element 13 may be turned semi-on.

In one embodiment, the operating principle in the current surge state is the same as the operating principle of the first voltage stabilizing element in the first sub-circuit according to various embodiments described above. When the second switching element 13 in the $N^{th}$ first sub-circuit is turned on, the first switching element 12 may be turned off. Alternatively, when the second switching element 13 in the $N^{th}$ first sub-circuit is turned semi-on, the first switching element 12 may be turned semi-off.

In some embodiments, in order to ensure the switching element can be turned off normally, referring to FIG. 11, the first sub-circuit may also include a voltage divider 18.

In the $N^{th}$ first sub-circuit, one terminal of the voltage divider 18 may be connected to the first node 17 in the $(N-1)^{th}$ first sub-circuit. The other terminal of the voltage divider 18 may be connected to the first terminal of the second switching element 13. Accordingly, the present disclosure also provides a voltage stabilization method, which can be applied to the voltage stabilization circuit shown in FIG. 11. The voltage stabilization method may include the following exemplary steps.

In one embodiment, when the first voltage stabilizing element in the $(N-1)^{th}$ first sub-circuit is in a first operating state, and the first voltage stabilizing element in the $N^{th}$ first sub-circuit is in a second operating state, in the $(N-1)^{th}$ first sub-circuit, the second switching element 13 may be controlled to be turned on, and the first switching element 12 may be controlled to be turned off. As such, the first voltage stabilizing element 11 in the $(N-1)^{th}$ first sub-circuit may be disconnected from the voltage stabilizing target 14.

In addition, in the $N^{th}$ first sub-circuit, the first switching element 12 may be controlled to be turned on, and the second switching element 13 may be controlled to be turned off. As such, the first voltage-stabilizing element 11 in the $N^{th}$ first sub-circuit may be connected with the voltage-stabilizing target 14.

In some implementations, in order to prevent the failure of the voltage stabilizing element from affecting the normal operation of the circuit, the voltage stabilization method may include the following exemplary steps. When the first voltage stabilizing element 11 in the $(N-1)^{th}$ first sub-circuit is in the first operating state, and the first voltage stabilizing element 11 in the $N^{th}$ first sub-circuit is in the first operating state, the second switching element 13 in the $(N-1)^{th}$ first sub-circuit may be controlled to be turned on, and the first switching element 12 may be controlled to be turned off. As such, the first voltage stabilizing element 11 in the $(N-1)^{th}$ first sub-circuit may be disconnected from the voltage stabilizing target 14.

In addition, in the $N^{th}$ first sub-circuit, the second switching element 13 may be controlled to be turned on, and the first switching element 12 may be controlled to be turned off. As such, the first voltage-stabilizing element 12 in the $N^{th}$ first sub-circuit may be disconnected from the voltage-stabilizing target 14.

In some embodiments, the voltage stabilization method may further include the following exemplary steps.

When the first voltage stabilizing element in the $(N-1)^{th}$ first sub-circuit is in a current surge state, in the $(N-1)^{th}$ first sub-circuit, the second switching element 13 may be controlled to be turned on, and the first switching element 12 may be turned off, and in the $N^{th}$ first sub-circuit, the first switching element 12 may be controlled to be turned on.

Alternatively, in the $(N-1)^{th}$ first sub-circuit, the second switching element 13 may be controlled to be turned semi-on, and the first switching element 12 may be turned semi-off. In the $N^{th}$ first sub-circuit, the first switching element 12 may be controlled to be turned semi-on.

In some embodiments, the voltage stabilization method may further include the following exemplary steps.

When the first voltage stabilizing element in the $N^{th}$ first sub-circuit is in a current surge state, in the $N^{th}$ first sub-circuit, the first switching element 12 may be turned off and the second switching element 13 may be turned on. Alternatively, the first switching element 12 may be turned semi-off, and the second switching element 13 may be turned semi-on.

In some embodiments, the voltage stabilization method may further include the following exemplary steps.

When the first voltage stabilizing element 11 in the $(N-1)^{th}$ first sub-circuit is switched from the current-surge operating state to the second operating state, in the $(N-1)^{th}$ first sub-circuit, the first switching element 12 may be controlled to be turned on, and the second switching element 13 may be controlled to be turned off. As such, the voltage stabilizing element in the previous stage may be connected to the voltage stabilizing target again. In the $N^{th}$ first sub-circuit, the first switching element 12 may be controlled to be turned off. As such, the first voltage-stabilizing element 11 of the subsequent stage may be disconnected from the voltage-stabilizing target 14.

Figure 12:
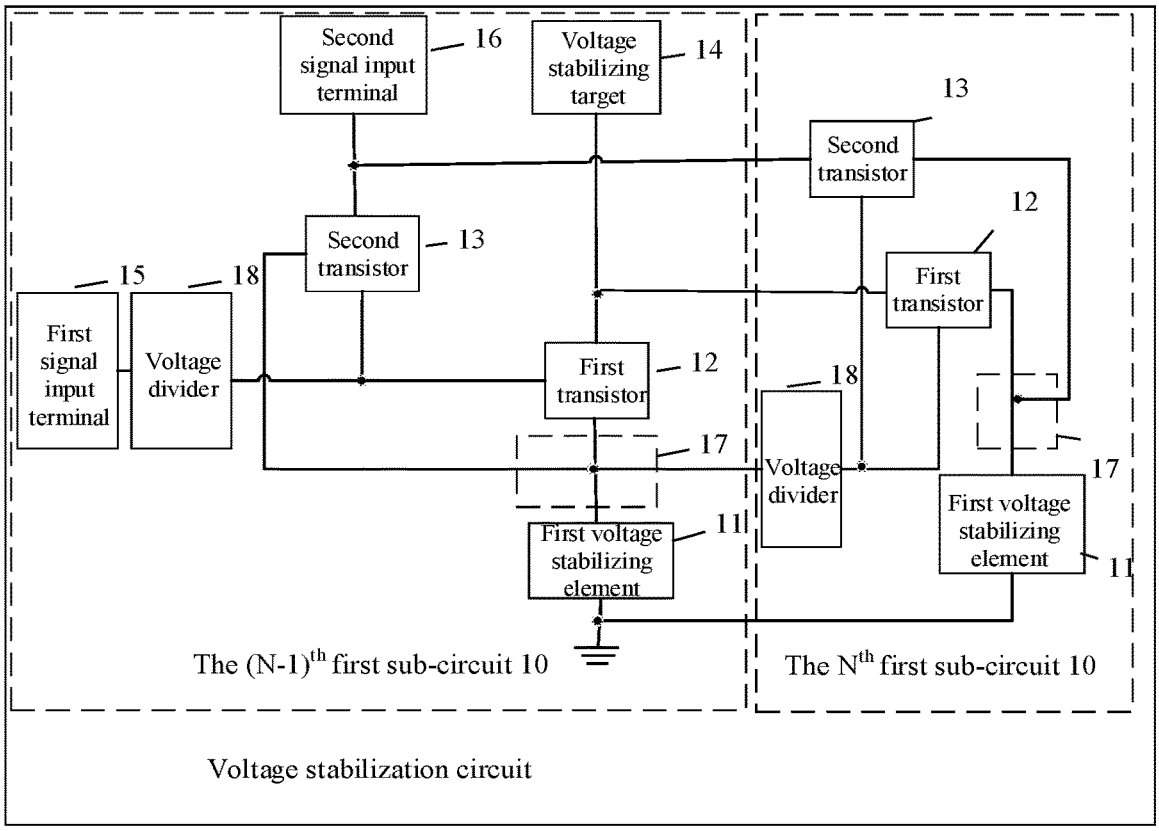
FIG. 12 illustrates a schematic structural diagram of another exemplary multi-stage voltage stabilization circuit according to an embodiment of the present disclosure.

FIG. 12 illustrates a schematic structural diagram of another exemplary multi-stage voltage stabilization circuit according to an embodiment of the present disclosure. Referring to FIG. 12, in one embodiment, the voltage stabilization circuit may include M first sub-circuits 10, where M is an integer greater than 1, and each first sub-circuit 10 may include a first voltage stabilizing element 11, a first switching element 12, and a second switching element 13. The first switching element 12 may include a first transistor Q1, and the second switching element 13 may include a second transistor Q2. In one embodiment of the present disclosure, the types of the first transistor Q1 and the second transistor Q2 are not limited. For example, the first transistor Q1 and the second transistor Q2 may be P-type transistors or N-type transistors.

It should be noted that the element connection relationship of each first sub-circuit is the same as the element connection relationship of the first sub-circuit in the embodiments described above, and the details are not repeated here.

The control terminal of the first transistor Q1 in the $N^{th}$ first sub-circuit, where N is an integer and $1 \leq N \leq M$, may be electrically connected to the first node 17 in the $(N-1)^{th}$ first sub-circuit, and the second terminal of the first transistor Q1 may be connected to the second terminal of the first transistor Q1 in the $(N-1)^{th}$ first sub-circuit.

Figure 13:
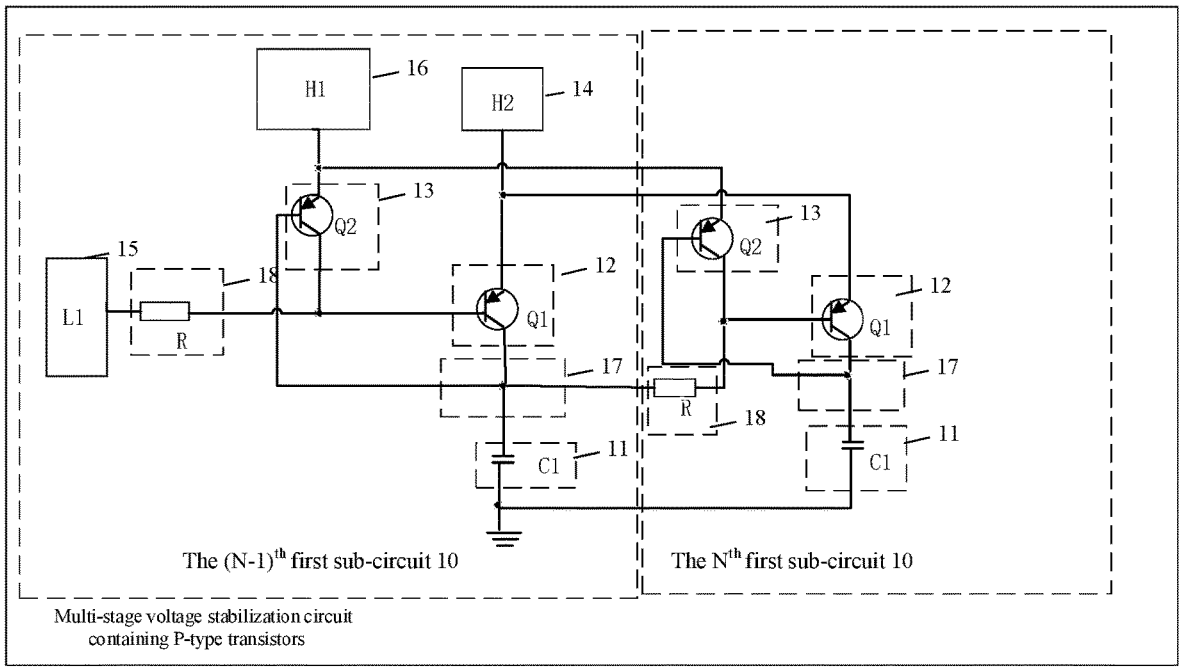
FIG. 13 illustrates a schematic structural diagram of an exemplary multi-stage voltage stabilization circuit including a P-type transistor according to an embodiment of the present disclosure.

FIG. 13 illustrates a schematic structural diagram of an exemplary multi-stage voltage stabilization circuit including a P-type transistor according to an embodiment of the present disclosure. Referring to FIG. 13, in one embodiment, the first transistor Q1 and the second transistor Q2 may be P-type transistors.

In one embodiment, the first signal input terminal 15 may be a negative voltage input terminal, and the second signal input terminal 16 may be a positive voltage input terminal. The voltage stabilizing target 14 may be a positive voltage operating signal. A negative voltage signal may be inputted into the negative voltage input terminal, a first positive voltage signal may be inputted into the positive voltage input terminal, and a second positive voltage signal may be inputted into the voltage stabilizing target. In one embodiment, the negative voltage signal may be the turn-on voltage L1 of the first transistor Q1, and the first negative voltage signal may be the turn-off voltage H1 of the first transistor Q1. The second negative voltage signal may be the operating signal H2. The turn-on voltage L1 may be a negative voltage signal, and the turn-off voltage H1 and the operating signal H2 may be positive voltage signals.

The gate of the first transistor Q1 in the $N^{th}$ first sub-circuit may be electrically connected to a first node 17 in the $(N-1)^{th}$ first sub-circuit, and the second terminal of the first transistor Q1 may be connected to the second terminal of the first transistor Q1 in the $(N-1)^{th}$ first sub-circuit.

In the above embodiment, the first sub-circuit of a subsequent stage may form a supplementary circuit for the first sub-circuit of a previous stage. As such, when the first sub-circuit of the previous stage cannot implement the voltage stabilization function, the first sub-circuit of the subsequent stage can replace the first sub-circuit of the previous stage to implement the voltage stabilization function.

In some embodiments, the voltage divider 18 may include a resistor R. For example, one terminal of the voltage divider 18 in the first sub-circuit of the first stage may be electrically connected to the node between the gate of the first transistor Q1 and the first terminal of the second transistor Q2, and the other terminal may be electrically connected to the negative voltage input terminal.

In one embodiment, in the $N^{th}$ first sub-circuit, one terminal of the voltage divider 18 may be connected to the first node 17 in the $(N-1)^{th}$ first sub-circuit, and the other terminal may be electrically connected to the node between the gate of the first transistor Q1 and the first terminal of the second transistor Q2.

Figure 14:
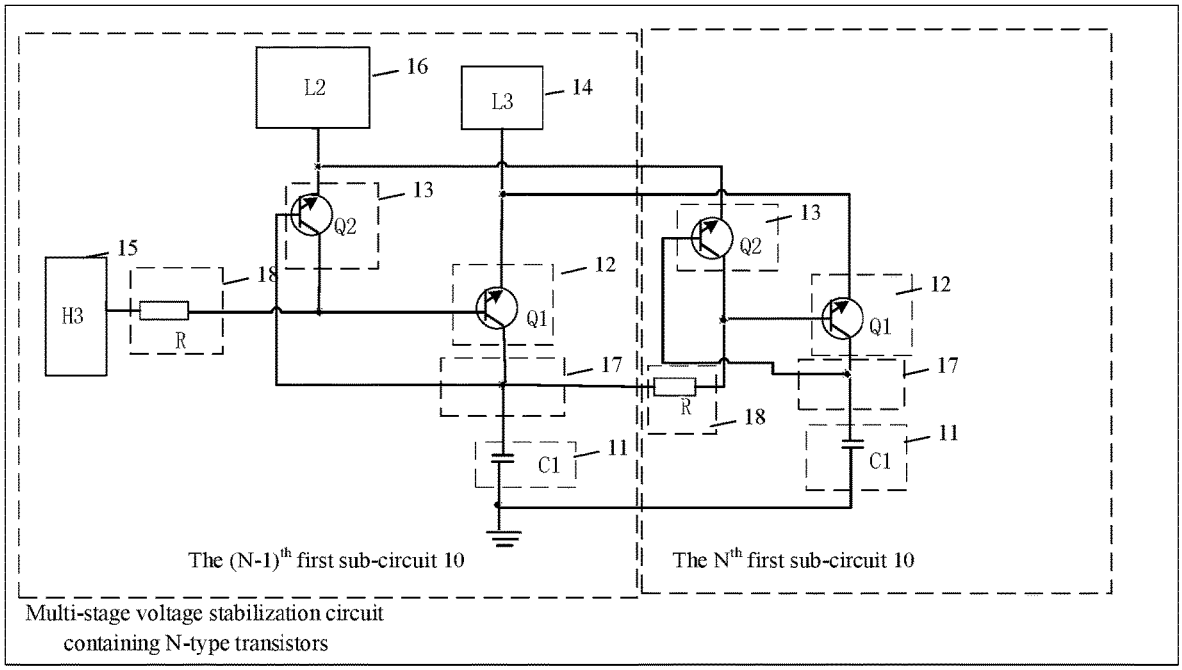
FIG. 14 illustrates a schematic structural diagram of an exemplary multi-stage voltage stabilization circuit including an N-type transistor according to an embodiment of the present disclosure.

In some embodiments, the first voltage stabilizing element 11 may include a first capacitor C1. FIG. 14 illustrates a schematic structural diagram of an exemplary multi-stage voltage stabilization circuit including an N-type transistor according to an embodiment of the present disclosure. Referring to FIG. 14, both the first transistor Q1 and the second transistor Q2 may be N-type transistors. Because an N-type transistor is turned on when the voltage difference between the gate and the second terminal of the transistor is greater than a threshold voltage, the conduction through the N-type transistor can also be understood as low-level conduction (e.g., the N-type transistor may be a low-level on transistor).

In one embodiment, the first signal input terminal 15 may be a positive voltage input terminal, and the second signal input terminal 16 may be a negative voltage input terminal. The voltage stabilizing target 14 may be a negative voltage operating signal. A positive voltage signal may be inputted in to the positive voltage input terminal, a first negative voltage signal may be inputted into the negative voltage input terminal, and a second negative voltage signal may be inputted into the voltage stabilizing target. In one embodiment, the positive voltage signal may be the turn-on voltage H3 of the first transistor Q1, and the first negative voltage signal may be the turn-off voltage L2 of the first transistor Q1. The second negative voltage signal may be the operating signal L3. The turn-on voltage H3 may be a positive voltage signal, and the turn-off voltage L2 and the operating signal L3 may be negative voltage signals.

The gate of the first transistor Q1 in the $N^{th}$ first sub-circuit may be electrically connected to the first node 17 in the $(N-1)^{th}$ first sub-circuit, and the second terminal of the first transistor Q1 may be connected to the second terminal of the first transistor Q1 in the $(N-1)^{th}$ first sub-circuit.

In some embodiments, as shown in FIGS. 13 and 14, the voltage divider 18 may include a resistor R. For example, one terminal of the voltage divider 18 in the first sub-circuit of the first stage is electrically connected to the node between the gate of the first transistor Q1 and the first terminal of the second transistor Q2, and the other terminal may be electrically connected to the positive voltage input terminal.

In some embodiments, the first voltage stabilizing element 11 may include a first capacitor C1.

It should be noted that, in the embodiments of the present disclosure, the first voltage stabilizing element may include, but is not limited to, a capacitor. For example, the first voltage stabilizing element may be one or more of electronic elements such as a diode, a transient diode, and a varistor.

In the above embodiment, the first sub-circuit of a subsequent stage may form a supplementary circuit for the first sub-circuit of a previous stage. As such, when the first sub-circuit of the previous stage cannot implement the voltage stabilization function, the first sub-circuit of the subsequent stage can replace the first sub-circuit of the previous stage to implement the voltage stabilization function. In addition, when the voltage stabilizing element cannot operate normally, by turning off the switching element, the inoperable voltage stabilizing element may be suspended from the voltage stabilization circuit to ensure the normal operation of the circuit.

Figure 15:
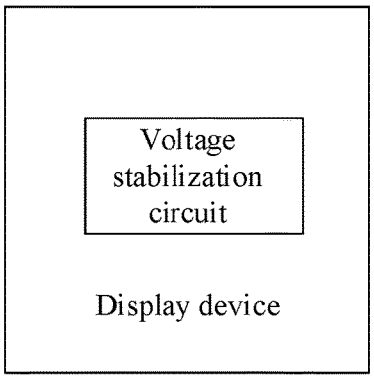
FIG. 15 illustrates a schematic structural diagram of an exemplary display device according to an embodiment of the present disclosure.

The present disclosure also provides a display device. FIG. 15 illustrates a schematic structural diagram of an exemplary display device according to an embodiment of the present disclosure. Referring to FIG. 15, the display device may include a voltage stabilization circuit consistent with an embodiment of the present disclosure. The display device may not only use the voltage stabilizing element to stabilize the operating signal, but also protect normal operation of other modules when the voltage stabilizing element fails.

In some embodiments, the display device may include a display panel and a flexible printed circuit board. The flexible printed circuit board may be electrically connected to the display panel. In one example, multiple elements in the voltage stabilization circuit may be all arranged on the flexible printed circuit board, or may all be arranged on the display panel. Alternatively, part of the elements may be arranged on the flexible printed circuit board, and another part of the elements may be arranged on the display panel. In the embodiments of the present disclosure, there is no limitation on the arrangement of the components. In one embodiment, the display panel may include various types of display panels, such as a liquid crystal display panel, an organic light emitting diode display panel, an electronic paper, etc. The display device may include terminal devices with display functions such as mobile phones, personal digital assistants, computers, etc.

Figure 16:
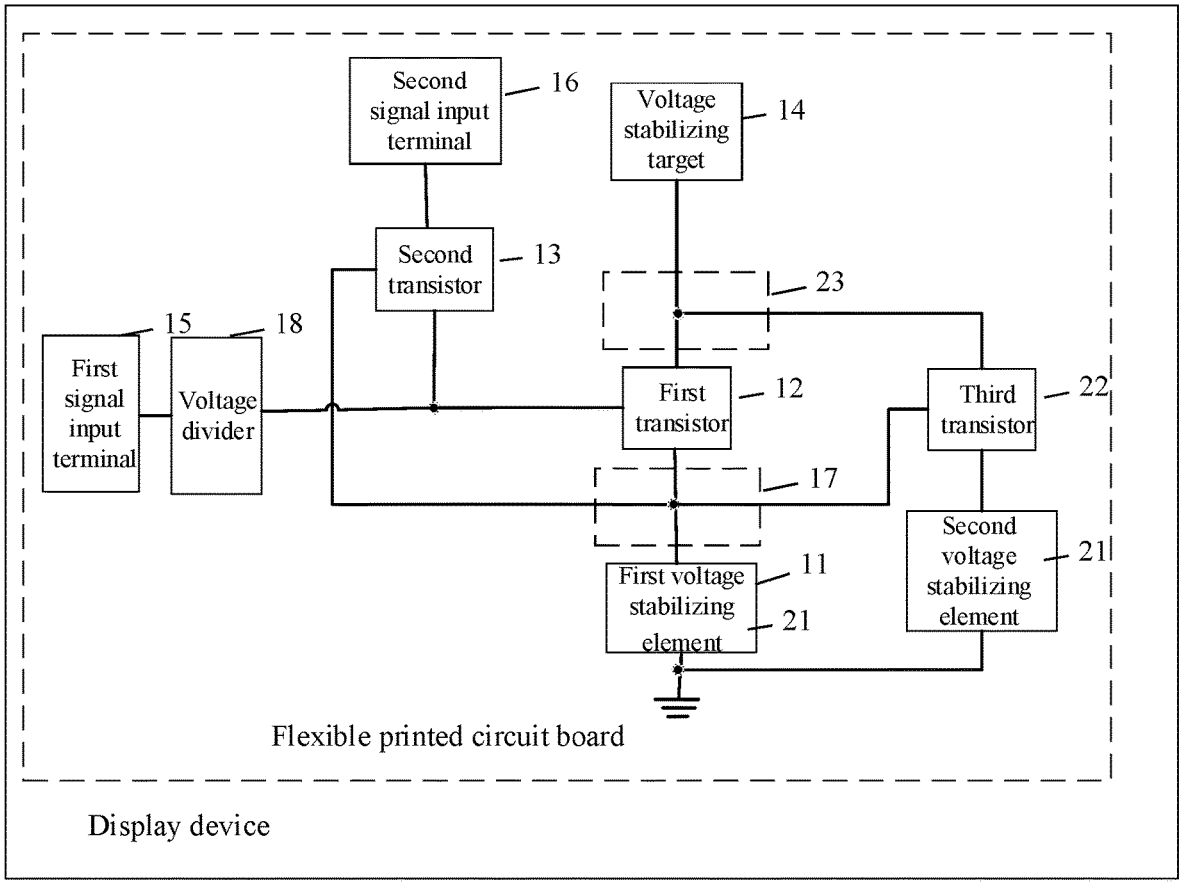
FIG. 16 illustrates a schematic structural diagram of another exemplary display device according to an embodiment of the present disclosure.

FIG. 16 illustrates a schematic structural diagram of another exemplary display device according to an embodiment of the present disclosure. Referring to FIG. 16, in one embodiment, the components in the voltage stabilization circuit can all be arranged on a flexible printed circuit board. The voltage stabilization circuit may include a first sub-circuit, and the first voltage stabilizing element 11, the first switching element 12, and the second switching element 13 in the first sub-circuit may all be arranged on a flexible printed circuit board.

In one embodiment, as an example, the output signal of the driving circuit or the input signal of the display panel may be stabilized by using a voltage stabilizing element provided on the flexible printed circuit board. At the same time, the use of the first switching element and the second switching element in the voltage stabilization circuit may be able to avoid the problem that other modules, such as the display panel, cannot function normally when the voltage stabilizing element fails.

In some embodiments, as shown in FIG. 16, the voltage stabilization circuit may further include a second sub-circuit. The second voltage stabilizing element 21 and the second opening element 22 may be arranged on the flexible printed circuit board. In this way, when the first voltage stabilizing element 11 fails, the second voltage stabilizing element 21 can replace the first voltage stabilizing element 11 to continue operating.

Figure 17:
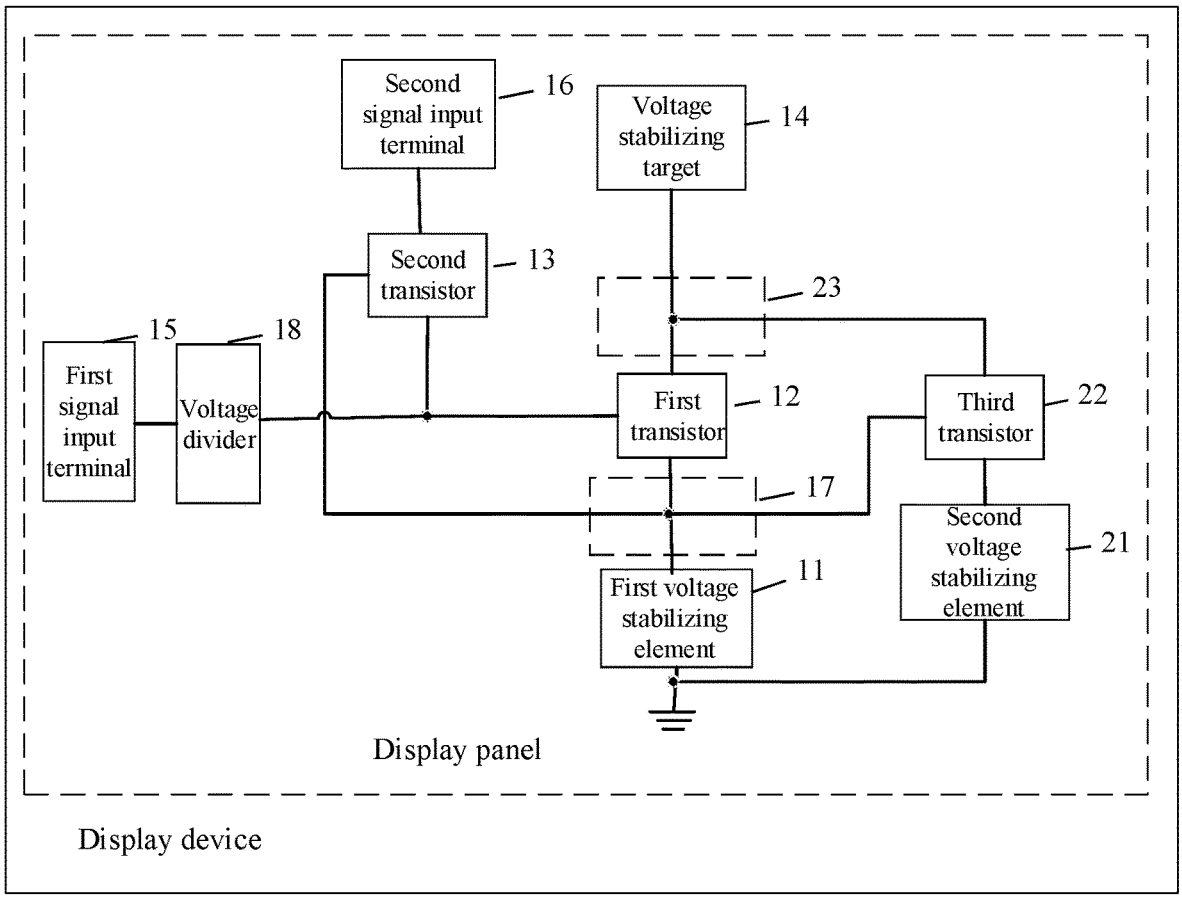
FIG. 17 illustrates a schematic structural diagram of another exemplary display device according to an embodiment of the present disclosure.

FIG. 17 illustrates a schematic structural diagram of another exemplary display device according to an embodiment of the present disclosure. Referring to FIG. 17, in one embodiment, the components in the voltage stabilization circuit can all be arranged on the display panel. The voltage stabilization circuit may include a first sub-circuit, and the first voltage stabilizing element 11, the first switching element 12, and the second switching element 13 of the first sub-circuit may all be arranged on the display panel.

In one embodiment, the voltage stabilizing element in the voltage stabilization circuit may be arranged on the display panel, and may be able to stabilize the operating signal in the display panel. The voltage stabilization circuit can avoid the problem that other circuits cannot be normal when the voltage stabilizing element fails.

In some embodiments, as shown in FIG. 17, the voltage stabilization circuit may further include a second sub-circuit, and the second voltage stabilizing element 21 and the second opening element 22 of the second sub-circuit may be arranged on the display panel. In this way, when the first voltage stabilizing element 11 fails, the second voltage stabilizing element 21 may be able to replace the first voltage stabilizing element 11 to continue operating.

Figure 18:
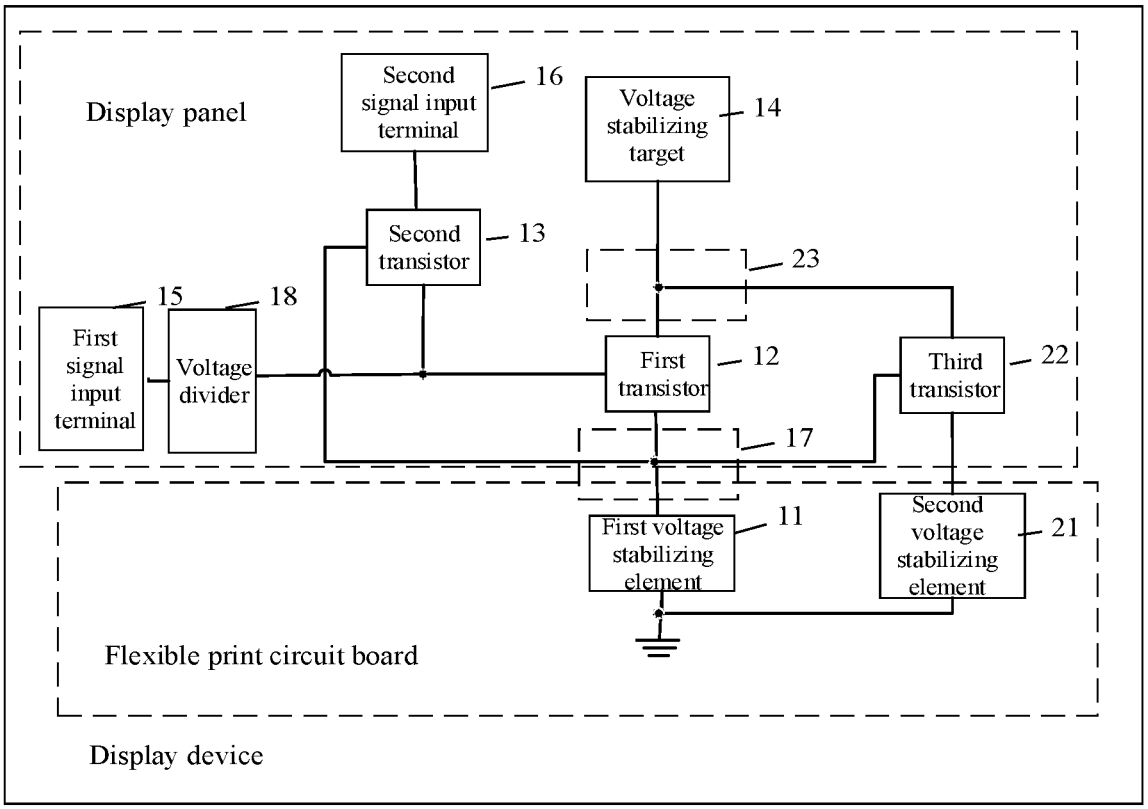
FIG. 18 illustrates a schematic structural diagram of another exemplary display device according to an embodiment of the present disclosure.

FIG. 18 illustrates a schematic structural diagram of another exemplary display device according to an embodiment of the present disclosure. Referring to FIG. 18, in one embodiment, part of the components in the voltage stabilization circuit may be arranged on the flexible printed circuit board, and another part of the components may be arranged on the display panel. The voltage stabilization circuit may include a first sub-circuit. For example, the first voltage stabilizing element 11 may be arranged on the flexible printed circuit board, and the first switching element 12 and the second switching element 13 may be both arranged on the display panel.

In some embodiments, as shown in FIG. 18, the voltage stabilization circuit may further include a second sub-circuit, and the second voltage stabilizing element 21 of the second sub-circuit may be arranged on the flexible printed circuit board, and the third open element 22 may be arranged on the display panel.

In one embodiment, the voltage stabilizing element in the voltage stabilization circuit may be arranged on the flexible printed circuit board, and the switching element may be arranged on the display panel. As such, the existing stabilizing element in the flexible printed circuit board can be used to form a stabilizing circuit to realize the normal operation of the stabilizing circuit. On the basis of this, there is no increase in the space of the flexible printed circuit board, and no additional cost is required.

In some embodiments, as shown in FIG. 16, FIG. 17, and FIG. 18, the voltage stabilization circuit may further include a voltage divider 18. One terminal of the voltage divider 18 may be electrically connected to a node between the control terminal of the first switching element 12 and the first terminal of the second switching element 13. In one embodiment, the voltage divider 18 may be arranged on a flexible printed circuit board or a display panel.

In some embodiments, the voltage stabilization circuit may further include M first sub-circuits, where M is an integer greater than 1. In one example, M may be 2. In one embodiment, the arrangement manner of the elements in each first sub-circuit may be the same as the arrangement manner of the elements in the first sub-circuit in the embodiments described above. For brevity, the details are not repeat here.

As such, using multiple first sub-circuits to form a voltage stabilization circuit can achieve voltage stabilization when the first sub-circuit of a previous stage cannot implement the voltage stabilization function, the first sub-circuit of a subsequent stage may be able to replace the first sub-circuit of the previous stage to implement voltage stabilization function.

It should be noted that the above are only some embodiments of the present disclosure and the applied technical principles. Those skilled in the art shall understand that the present disclosure is not limited to the specific embodiments described herein, and various obvious changes, readjustments, combinations and substitutions can be made without departing from the protection scope of the present disclosure. Therefore, although the present disclosure has been described in detail through the above embodiments, the present disclosure is not limited to the above embodiments, and can also include other equivalent embodiments without departing from the principle of the present disclosure. Any equivalent or modification thereof, without departing from the spirit and principle of the present disclosure, falls within the true scope of the present disclosure.

What is claimed is:

1. A voltage stabilization circuit, comprising a first sub-circuit, wherein the first sub-circuit includes:

a first voltage stabilizing element;

a first switching element; and a second switching element, wherein:

a first terminal of the first voltage stabilizing element is electrically connected to a first node, and a second terminal of the first voltage stabilizing element is grounded, a first terminal of the first switching element is electrically connected to the first node, and a second terminal of the first switching element is electrically connected to a voltage stabilizing target, a first terminal of the second switching element is electrically connected to a control terminal of the first switching element, and a control terminal of the second switching element is electrically connected to the first node, and when the first voltage stabilizing element is in a first operating state, the second switching element is turned on, and the first switching element is turned off.

2. The voltage stabilization circuit according to claim 1, wherein:

when the first voltage stabilizing element is in a second operating state, the first switching element is turned on, and the second switching element is turned off.

3. The voltage stabilization circuit according to claim 1, wherein:

when the first voltage stabilizing element is in a current surge state, the second switching element is turned on and the first switching element is turned off, or the second switching element is turned semi-on and the first switching element is turned semi-off.

4. The voltage stabilization circuit according to claim 2, further including a second sub-circuit, wherein the second sub-circuit includes:

a second voltage stabilizing element and a third switching element, wherein:

a first terminal of the second voltage stabilizing element is electrically connected to a first terminal of the third switching element, and a second terminal of the second voltage stabilizing element is grounded;

a control terminal of the third switching element is electrically connected to the first node, and a second terminal of the third switching element is electrically connected to a second node; and when the first voltage stabilizing element is in the first operating state, and the second voltage stabilizing element is in the second operating state, the second switching element is turned on, the first switching element is turned off, and the third switching element is turned on.

5. The voltage stabilization circuit according to claim 1, wherein:

the first switching element includes a first transistor;

the second switching element includes a second transistor; and each of the first transistor and the second transistor includes a P-type transistor or an N-type transistor.

6. The voltage stabilization circuit according to claim 5, wherein:

the first transistor and the second transistor are both P-type transistors;

a first terminal of the first transistor is electrically connected to the first node, a second terminal of the first transistor is electrically connected to the voltage stabilizing target, and a control terminal of the first transistor is electrically connected to a first terminal of the second transistor; and the first terminal of the second transistor is connected to a negative voltage input terminal, a second terminal of the second transistor is electrically connected to a positive voltage input terminal, and a control terminal of the second transistor is electrically connected to the first node.

7. The voltage stabilization circuit according to claim 5, wherein:

the first transistor and the second transistor are both N-type transistors;

a first terminal of the first transistor is electrically connected to the first node, a second terminal of the first transistor is electrically connected to the voltage stabilizing target, and a control terminal of the first transistor is electrically connected to a first terminal of the second transistor; and the first terminal of the second transistor is electrically connected to a positive voltage input terminal, a second terminal of the second transistor is electrically connected to a negative voltage input terminal, and a control terminal of the second transistor is electrically connected to the first node.

8. The voltage stabilization circuit according to claim 1, further including a voltage divider, wherein:

one terminal of the voltage divider is electrically connected to a node between the control terminal of the first switching element and the first terminal of the second switching element.

9. The voltage stabilization circuit according to claim 1, wherein:

the first voltage stabilizing element includes a first capacitor.

10. The voltage stabilization circuit according to claim 1, wherein:

the voltage stabilization circuit includes at least M first sub-circuits, where M is an integer greater than 1;

in an $N^{th}$ first sub-circuit, where N is an integer and $1 \leq N \leq M$:

a first terminal of the first voltage stabilizing element is electrically connected to a first terminal of the first switching element, and a second terminal of the first voltage stabilizing element is grounded, a control terminal of the first switching element is electrically connected to the first node in an $(N-1)^{th}$ first sub-circuit, and a second terminal of the first switching element is connected to a second terminal of the first switching element in the $(N-1)^{th}$ first sub-circuit, a control terminal of the second switching element is electrically connected to the first node, a first terminal of the second switching element is electrically connected to the control terminal of the first switching element, and a second terminal of the second switching element is electrically connected to a second terminal of the second switching element in the $(N-1)^{th}$ first sub-circuit; and when the first voltage stabilizing element in the $(N-1)^{th}$ first sub-circuit is in the first operating state, in the $(N-1)^{th}$ first sub-circuit, the second switching element is turned on, the first switching element is turned off; and in the $N^{th}$ first sub-circuit, the first switching element is turned on and the second switching element is turned off.

11. A voltage stabilization method, applied to a voltage stabilization circuit, wherein:

the voltage stabilization circuit includes a first sub-circuit; and the first sub-circuit includes a first voltage stabilizing element, a first switching element, and a second switching element, wherein:

a first terminal of the first voltage stabilizing element is electrically connected to a first node, and a second terminal of the first voltage stabilizing element is grounded, a first terminal of the first switching element is electrically connected to the first node, and a second terminal of the first switching element is electrically connected to a voltage stabilizing target, and a first terminal of the second switching element is electrically connected to a control terminal of the first switching element, and a control terminal of the second switching element is electrically connected to the first node, when the first voltage stabilizing element is in a first operating state, the voltage stabilization method includes:

controlling the second switching element to be turned on and the first switching element to be turned off to disconnect the first voltage stabilizing element from the voltage stabilizing target.

12. The voltage stabilization method according to claim 11, when the first voltage stabilizing element is in a second operating state, further including:

controlling the first switching element to be turned on and the second switching element to be turned off to connect the voltage stabilizing target to the first voltage stabilizing element.

13. The voltage stabilization method according to claim 11, when the first voltage stabilizing element is in a current surge state, further including:

controlling the second switching element to be turned on and the first switching element to be turned off, or controlling the second switching element to be turned semi-on and the first switching element to be turned semi-off.

14. The voltage stabilization method according to claim 11, wherein:

the voltage stabilization circuit further includes a second sub-circuit, including a second voltage stabilizing element and a third switching element, wherein:

a first terminal of the second voltage stabilizing element is electrically connected to a first terminal of the third switching element, and a second terminal of the second voltage stabilizing element is grounded, and a control terminal of the third switching element is electrically connected to the first node, and a second terminal of the third switching element is electrically connected to a second node; and when the first voltage stabilizing element is in the first operating state, the voltage stabilization method further includes:

controlling the second switching element and the third switching element to be turned on, and the first switching element to be turned off to disconnect the first voltage stabilizing element from the voltage stabilizing target and connect the second voltage stabilizing element to the voltage stabilizing target.

15. The voltage stabilization method according to claim 11, wherein:

the first switching element includes a first transistor, the second switching element includes a second transistor, and the first transistor and the second transistor are both P-type transistors;

a first terminal of the second switching element is electrically connected to a negative voltage input terminal, and a second terminal of the second switching element is connected to a positive voltage input terminal; and the voltage stabilization method further includes:

inputting a negative voltage input signal to the negative voltage input terminal;

inputting a first positive voltage input signal to the positive voltage input terminal; and inputting a second positive voltage input signal to the voltage stabilizing target.

16. The voltage stabilization method according to claim 11, wherein:

the first switching element includes a first transistor, the second switching element includes a second transistor, and the first transistor and the second transistor are both N-type transistors;

a first terminal of the second switching element is electrically connected to a positive voltage input terminal, and a second terminal of the second switching element is connected to a negative voltage input terminal; and the voltage stabilization method further includes:

inputting a positive voltage input signal to the positive voltage input terminal;

inputting a first negative voltage input signal to the negative voltage input terminal; and inputting a second negative voltage input signal to the voltage stabilizing target.

17. The voltage stabilization method according to claim 12, wherein:

the voltage stabilization circuit includes at least M first sub-circuits, where M is an integer greater than 1, wherein in an $N^{th}$ first sub-circuit, where N is an integer and $1 \leq N \leq M$:

a first terminal of the first voltage stabilizing element is electrically connected to a first terminal of the first switching element, and a second terminal of the first voltage stabilizing element is grounded, a control terminal of the first switching element is electrically connected to the first node in an $(N-1)^{th}$ first sub-circuit, and a second terminal of the first switching element is connected to a second terminal of the first switching element in the $(N-1)^{th}$ first sub-circuit, and a control terminal of the second switching element is electrically connected to the first node, a first terminal of the second switching element is electrically connected to the control terminal of the first switching element, and a second terminal of the second switching element is electrically connected to a second terminal of the second switching element in the $(N-1)^{th}$ first sub-circuit; and when the first voltage stabilizing element in an $(N-1)^{th}$ first sub-circuit is in the first operating state and the first voltage stabilizing element in an $N^{th}$ first sub-circuit is in the second operating state, the voltage stabilization method further includes:

controlling the second switching element in the $(N-1)^{th}$ first sub-circuit to be turned on, the first switching element in the $(N-1)^{th}$ first sub-circuit to be turned off, the first switching element in the $N^{th}$ first sub-circuit to be turned on, and the second switching element in the $N^{th}$ first sub-circuit to be turned off to disconnect the first voltage stabilizing element in the $(N-1)^{th}$ first sub-circuit from the voltage stabilizing target and connect the first voltage stabilizing element in the $N^{th}$ first sub-circuit to the voltage stabilizing target.

18. A display device, comprising a voltage stabilization circuit, wherein:

the voltage stabilization circuit includes a first sub-circuit; and the first sub-circuit includes:

a first voltage stabilizing element;

a first switching element; and a second switching element, wherein:

a first terminal of the first voltage stabilizing element is electrically connected to a first node, and a second terminal of the first voltage stabilizing element is grounded, a first terminal of the first switching element is electrically connected to the first node, and a second terminal of the first switching element is electrically connected to a voltage stabilizing target, a first terminal of the second switching element is electrically connected to a control terminal of the first switching element, and a control terminal of the second switching element is electrically connected to the first node, and when the first voltage stabilizing element is in a first operating state, the second switching element is turned on, and the first switching element is turned off.

19. The display device according to claim 18, further including:

a display panel; and a flexible printed circuit board, wherein:

the flexible printed circuit board is electrically connected with the display panel; and the first voltage stabilizing element is disposed on the flexible printed circuit board or the display panel.

20. The display device according to claim 19, wherein:

the first switching element is disposed on the flexible printed circuit board or the display panel; and the second switching element is disposed on the flexible printed circuit board or the display panel.

* * * * *